US008577237B2

(12) United States Patent
Aoki

(10) Patent No.: US 8,577,237 B2
(45) Date of Patent: Nov. 5, 2013

(54) IMAGE FORMING APPARATUS

(75) Inventor: Shinji Aoki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 325 days.

(21) Appl. No.: 12/929,606

(22) Filed: Feb. 3, 2011

(65) Prior Publication Data

US 2011/0200348 A1 Aug. 18, 2011

(30) Foreign Application Priority Data

Feb. 15, 2010 (JP) ..... 2010-030239

(51) Int. Cl.
*G03G 15/16* (2006.01)

(52) U.S. Cl.
USPC ..... 399/66

(58) Field of Classification Search
USPC ..... 399/66, 297
See application file for complete search history.

(56) References Cited

U.S. PATENT DOCUMENTS

| | | | | |
|---|---|---|---|---|
| 8,369,729 | B2 * | 2/2013 | Torimaru | 399/66 |
| 2009/0123168 | A1 | 5/2009 | Aoki et al. | |
| 2010/0232820 | A1 | 9/2010 | Usami et al. | |
| 2010/0284705 | A1 | 11/2010 | Aoki et al. | |

FOREIGN PATENT DOCUMENTS

| | | | |
|---|---|---|---|
| JP | 05181373 | A | 7/1993 |
| JP | 06289682 | A | 10/1994 |
| JP | 06-044542 | A | 11/1994 |
| JP | 08083006 | A | 3/1996 |
| JP | 2704277 | A | 10/1997 |
| JP | 3340221 | A | 8/2002 |
| JP | 2003186284 | A | 7/2003 |

OTHER PUBLICATIONS

Translation of Yuuji (JP 2003 186284 A, listed in IDS, pub. date Jul. 3, 2003).*

Abstract of Japanese Patent Publication No. H07-175340, published on Jul. 14, 1995.

Abstract of Japanese Patent Publication No. H02-123385, published on May 10, 1990.

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

In an image forming apparatus, a transfer current output unit outputs a transfer current having a same value as a target value to a nip forming member to transfer a toner image on a latent image carrier to the nip forming member to determine the target value based on an algorithm representing a relationship between an image area ratio of the toner image and the target value and the image area ratio, and in an algorithm for a second transfer step in which the toner image is transferred to be superimposed on the toner image of the nip forming member to which the toner image has been transferred, a smaller target value is related to a same image area ratio compared to the algorithm for a first transfer step in which the toner image is transferred to the nip forming member to which no toner image is transferred.

18 Claims, 16 Drawing Sheets

IMAGE FORMING APPARATUS

CROSS-REFERENCE TO RELATED APPLICATIONS

The present application claims priority to and incorporates by reference the entire contents of Japanese Patent Application No. 2010-030239 filed in Japan on Feb. 15, 2010.

BACKGROUND OF THE INVENTION

1. Field of the Invention

The invention relates to an image forming apparatus, such as a copy machine, a facsimile machine, or a printer.

2. Description of the Related Art

This type of image forming apparatus is described in Japanese Patent Application Laid-open No. 8-83006. This image forming apparatus forms a monochrome image on a recording sheet by a combination of a photosensitive element serving as a latent image carrier and a transfer roller serving as a nip forming member, which comes into contact with the photosensitive element to form a transfer nip. A transfer bias having a polarity opposite to the normally charged polarity of toner is applied to the transfer roller. A toner image on the photosensitive element is transferred to a recording sheet serving as a recording member fed into the transfer nip. On the surface of the photosensitive element, all of a non-image portion and an image portion (latent image portion) are charged with the same polarity with the normally charged polarity of toner, and the potential of the non-image portion becomes higher than the potential of the image portion. At the exit of the transfer nip, a current flows between the nip forming member and the photosensitive element in accordance with separating discharge therebetween. At this time, a larger current flows in the non-image portion having a higher potential than the image portion. For this reason, when the image area ratio on the photosensitive element at the exit of the transfer nip is comparatively low, if a larger current is not output from a power supply compared to a case where the image area ratio is relatively high, a necessary current may not flow in the image portion, causing defective transfer. If defective transfer occurs, irregularity in image density depending on the image area ratio occurs. Thus, this image forming apparatus is configured such that the output target value of the transfer current from the power supply differs depending on the above-described image area ratio. With this configuration, it is possible to obtain stable image density regardless of the image area ratio.

Meanwhile, in the related art, an image forming apparatus is known in which a color image is formed through so-called superimposing transfer (for example, see Japanese Patent Application Laid-open No. 2003-186284). Superimposition transfer is processing in which a plurality of toner images on a latent image carrier, such as a photosensitive element, are superimposed on a transfer member, such as an intermediate transfer member. As a method which realizes superimposing transfer, various methods are known.

For example, in the image forming apparatus described in Japanese Patent Application Laid-open No. 2003-186284, superimposing transfer is realized by a so-called tandem method. Specifically, the image forming apparatus has four photosensitive elements which respectively form toner images of Y (yellow), M (magenta), C (cyan), and Bk (black). The image forming apparatus also has an intermediate transfer belt serving as a nip forming member which comes into contact with the photosensitive elements to form Y, M, C, and Bk primary transfer nips. At the Y primary transfer nip, the Y toner image on the Y photosensitive element is transferred to the intermediate transfer belt. Thereafter, in the M primary transfer nip, the M toner image on the M photosensitive element is transferred to be superimposed on the Y toner image of the intermediate transfer belt. Hereinafter, similarly, in the C and Bk primary transfer nips, the C and Bk toner images are transferred to be superimposed on the Y and M toner images of the intermediate transfer belt. With superimposing transfer, it is possible to form a color image on the intermediate transfer belt.

An image forming apparatus is also known in which superimposing transfer is realized using a photosensitive element, four developing units developing a latent image formed on the photosensitive element with Y, M, C, and Bk toners, respectively, and an intermediate transfer belt. In this type of image forming apparatus, while the intermediate transfer belt is moving substantially over four revolutions, toner of a different color is formed on the photosensitive element in each revolution and transferred to the intermediate transfer belt in a superimposing manner. In this way, it is possible to form a color image on the intermediate transfer belt.

With the configuration in which a color image is formed by the transfer method in each revolution or the above-described tandem method, similarly to the image forming apparatus described in Japanese Patent Application Laid-open No. 8-83006, irregularity in image density depending on the image area ratio may occur. Thus, the inventors have conducted an experiment in which, in a tandem-type color printer tester, the target value of an output current from each of the Y, M, C, and Bk primary transfer power supplies differs depending on the image area ratio of a corresponding one of the Y, M, C, and Bk photosensitive elements. When this happens, the toner images of the respective colors can be primarily transferred efficiently from the photosensitive element to the intermediate transfer belt, but a toner image on the belt is reversely transferred noticeably to the non-image portion of the photosensitive element in a downstream-side primary transfer nip. For example, the Y toner image which has been satisfactorily transferred to the intermediate transfer belt in the Y primary transfer nip is reversely transferred in large quantity to the non-image portions of the M, C, and Bk photosensitive elements in the downstream-side M, C, and Bk primary transfer nips. Similarly, the M toner image is reversely transferred in the C and Bk primary transfer nips, and the C toner image is reversely transferred in the Bk primary transfer nip.

Reverse transfer easily occurs in a state where an area having a comparatively low image area ratio of the circumferential surface of the photosensitive element and a toner image which has already been transferred to the intermediate transfer belt are moved simultaneously into a primary transfer nip. As in the related art, with the configuration in which a constant transfer current is output regardless of the image area ratio of the photosensitive element, if such a state is reached, most of the photosensitive element within the nip becomes a non-image portion. For this reason, a current easily flows between the photosensitive element and the belt, reducing the potential of the belt. Thus, the potential difference between the non-image portion of the photosensitive element and the intermediate transfer belt decreases, such that discharge does not easily occur between the non-image portion of the photosensitive element and the intermediate transfer belt. As a result, reverse transfer of toner is suppressed. Meanwhile, in the color printer tester in which the target value of the transfer current varies depending on the image area ratio, if the above-described state is reached, the target value increases so as to allow a sufficient current to flow in the image portion having a small area, such that the potential of the belt is scarcely reduced. It could be seen that, when this happens, discharge is not suppressed between the non-image portion of the photosensitive element and the belt, such that reverse transfer of toner noticeably occurs.

Thus, the inventors have carefully studied an appropriate set range of the target value of the transfer current and have understood the following. That is, the above-described color printer tester is configured such that the toner images are sequentially transferred to the belt in order of Y, M, C, and Bk. While the toner image which has been transferred to the intermediate transfer belt in the uppermost stream-side Y primary transfer nip sequentially passes through the M, C, and Bk primary transfer nips, it is impossible to completely eliminate loss of toner in the toner image. In any case, a small amount of toner is stuck to the photosensitive element in the primary transfer nip for the second and latter colors. For this reason, the Y toner image which passes through the primary transfer nips for all colors is likely to decrease in image density compared to the M, C, and Bk toner images which pass through only a portion of the primary transfer nips. Thus, in the Y primary transfer nip, it is preferable to set the target value of the transfer current such that the maximum transfer efficiency is substantially obtained. Specifically, in the primary transfer nip, as the primary transfer current increases, the transfer efficiency tends to increase. However, if the primary transfer current excessively increases, the transfer efficiency is significantly deteriorated adversely. This is because the potential difference between the image portion of the photosensitive element and the belt increases more than the discharge start voltage, such that toner on the image portion is reversely transferred due to discharge therebetween. If the potential difference between the image portion of the photosensitive element and the intermediate transfer belt is maintained at a value slightly smaller than the discharge start voltage, it is possible to obtain substantially the maximum transfer efficiency. The transfer current value which maintains the above-described potential difference at a value slightly smaller than the discharge start voltage differs depending on the image area ratio on the photosensitive element. It should suffice that the relationship between the transfer current value and the discharge start voltage is found in advance and stored as an algorithm (relationship expression, data table, or the like). Meanwhile, if the above-described potential difference is set at a value slightly smaller than the discharge start voltage, the potential difference between the non-image portion of the photosensitive element and the intermediate transfer belt increases more than the discharge start voltage. This is because the non-image portion and the image portion both have a polarity opposite to the transfer bias, and the potential of the non-image portion is higher than that of the image portion. For this reason, in the M, C, and Bk primary transfer nips, if the target value of the transfer current is set in the same manner as the Y primary transfer nip, noticeable reverse transfer occurs.

SUMMARY OF THE INVENTION

It is an object of the present invention to at least partially solve the problems in the conventional technology. According to the present invention, there is provided an image forming apparatus including: a latent image carrier that carries a latent image; a developing unit that develops the latent image on the latent image carrier with toner to obtain a toner image; a nip forming member that comes into contact with the latent image carrier to form a transfer nip; and a transfer current output unit that outputs a transfer current having a same current value as a predetermined target value to the nip forming member to transfer the toner image on the latent image carrier to the nip forming member or a recording member held on a surface of the nip forming member, and determines the target value based on an algorithm representing a relationship between an image area ratio of the toner image on the latent image carrier and the target value and the image area ratio, wherein a first transfer step in which the toner image on the latent image carrier is transferred to the nip forming member or the recording member to which no toner image is transferred and a second transfer step in which the toner image on the latent image carrier is transferred to be superimposed on the toner image of the nip forming member or the recording member to which the toner image has already been transferred are performed to form a superimposed toner image, and the transfer current output unit is configured to perform processing as the algorithm for the second transfer step in which the target value having a smaller value is related to a same image area ratio compared to the algorithm for the first transfer step.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment will be described where it is applied to a color printer (hereinafter, simply referred to as a printer) serving as an image forming apparatus which forms a color image by a tandem-type image forming section.

Figure 1:
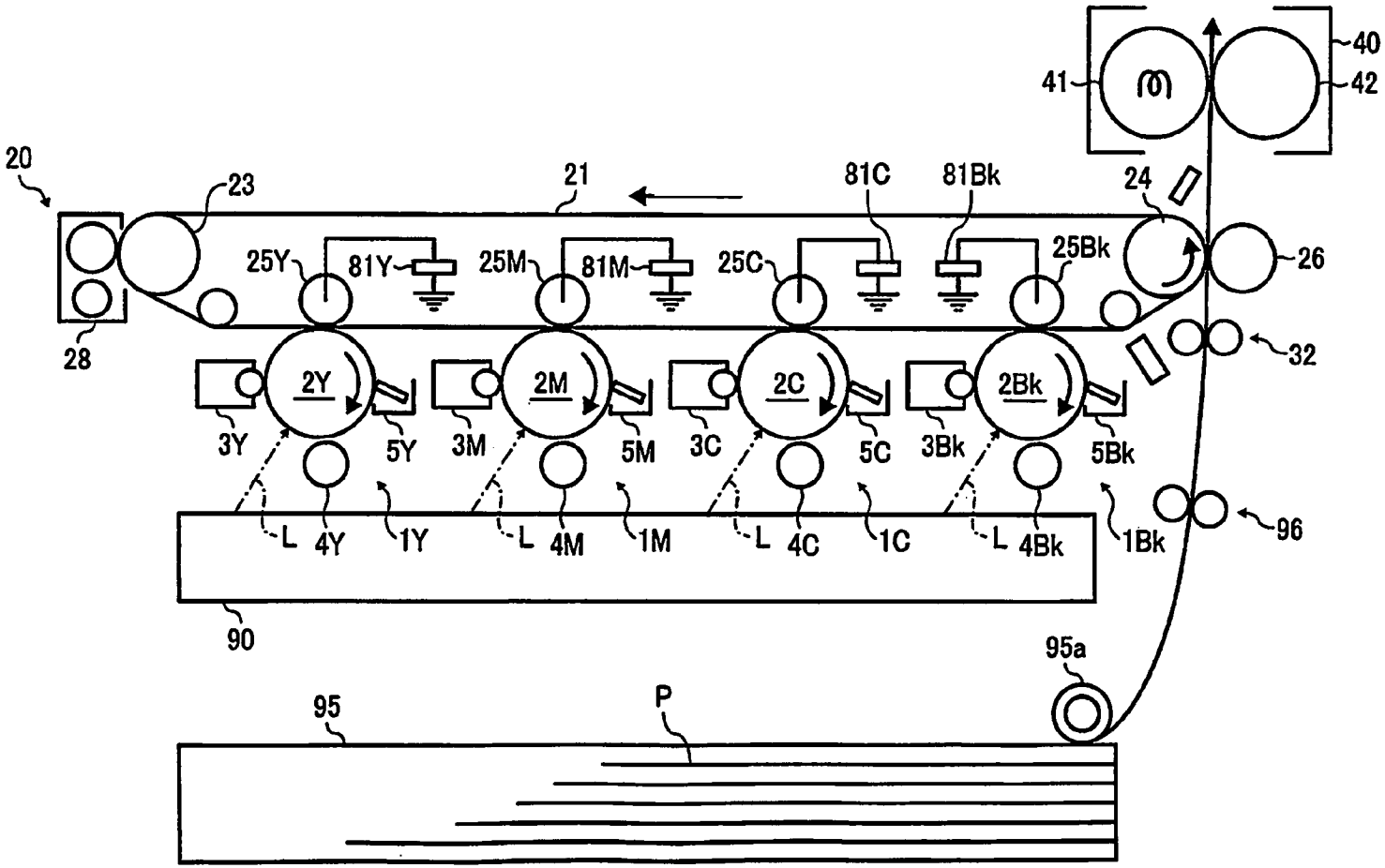
FIG. 1 is a schematic configuration diagram showing a printer according to an embodiment.

First, the basic configuration of a printer according to the embodiment will be described. FIG. 1 is a schematic configuration diagram showing the printer according to the embodiment. The printer includes four process units 1Y, 1M, 1C, and 1Bk for yellow, magenta, cyan, and black (hereinafter, referred to as Y, M, C, and Bk) as a toner image forming unit. The process units 1Y, 1M, 1C, and 1Bk have the same configuration, except for using Y, M, C, and Bk toner of different colors as an image forming material for forming an image.

Description will be provided focusing on the process unit 1Y for generating a Y toner image. The processing unit 1Y is configured such that a photosensitive element 2Y, a developing unit 3Y, a charging unit, a photosensitive element cleaning unit 5Y, and the like are held in the common holding member as a single unit, and is attached and detached as a single body with respect to a printer main body.

The charging unit has a charging roller 4Y which is provided to be in contact with or close to the photosensitive element 2Y. The charging roller 4Y is driven to rotate by a driving unit (not shown). A predetermined charging bias is applied from a charging power supply to the charging roller 4Y. Discharging is generated between the charging roller 4Y and the photosensitive element 2Y, such that the surface of the photosensitive element 2Y is uniformly charged with the same polarity as the normal charged polarity of toner. Instead of the charging unit of this type, a scorotron-type charger or the like may be used.

The photosensitive element 2Y is constituted by a drum having a diameter 30 [mm] with an organic photosensitive layer on the surface thereof, and electrostatic capacitance is adjusted to 9.5E-7 [F/m$^2$]. The photosensitive element 2Y is driven to rotate in the clockwise direction of the drawing by a driving unit (not shown). The surface of the photosensitive element 2Y which is uniformly charged by the charging unit is exposed and scanned by laser light emitted to an optical writing unit 90 described below, such that a Y electrostatic latent image is carried thereon.

The developing unit 3Y accommodates a developer (not shown) containing Y toner and a magnetic carrier. An opening is formed in a casing of the developing unit 3Y, and a portion of the circumferential surface of a cylindrical developing sleeve is exposed from the opening and faces the surface of the photosensitive element 2Y. The developing sleeve carries the developer in the casing by a magnetic force from a magnet roller (not shown) which is fixed inward so as not to rotate along with the developing sleeve. With the rotation of the developing sleeve, the developing sleeve conveys the developer to a developing area where the developing sleeve and the photosensitive element 2Y face each other. In the developing area, a developing potential is applied between the developing sleeve and the electrostatic latent image of the photosensitive element 2Y to move Y toner having a negative polarity from the sleeve to the photosensitive element. A non-image potential is applied between the developing sleeve and the non-image portion of the photosensitive element 2Y to move Y toner having a negative polarity from the photosensitive element to, the sleeve. In the developing area, Y toner in the developer is changed to the electrostatic latent image of the photosensitive element 2Y by the action of the above-described developing potential. Thus, the electrostatic latent image on the photosensitive element 2Y is developed and becomes a Y toner image.

The developing unit 3Y has a toner density sensor (not shown) which measures the toner density of the developer therein. The detection result of the toner density sensor is sent as a voltage signal to a control section (not shown). The control section includes a RAM which stores the target value of an output voltage from the toner density sensor. The value of the output voltage from the toner density sensor is compared with the target value, and a Y toner supply unit is driven for a time according to the comparison result. With this driving, an appropriate amount of Y toner is supplied to the developer in which the Y toner density is lowered with consumption of Y toner for development. For this reason, the toner density of the developer in the developing unit 3Y is maintained in a predetermined range. The same toner supply control is performed for the developer of the developing unit (3M, 3C, or 3Bk) for another color.

Although the Y process unit 1Y has been described in detail, the process units 1M, 1C, and 1Bk for other colors have the same configuration, and M, C, and Bk toner images are respectively formed on the photosensitive elements 2M, 2C, and 2Bk. The Y, M, C, and Bk toner images are respectively developed by the developing units 3Y, 3M, 3C, and 3Bk. When a solid image is formed on the entire surface of the photosensitive element, the stuck toner amount per unit area is about 0.45 [mg/cm$^2$].

An optical writing unit 90 is provided below the process units 1Y, 1M, 1C, and 1Bk. The optical writing unit 90 serving as a latent image forming unit irradiates laser light L based on image information onto the uniformly charged surface of each of the photosensitive elements 2Y, 2M, 2C, and 2Bk. The potential of a laser exposed portion in each of the photosensitive elements 2Y, 2M, 2C, and 2Bk is attenuated and becomes lower than the ambient non-image portion. The places in this state become the Y, M, C, and Bk electrostatic latent images. The optical writing unit 90 irradiates laser light L emitted from a light source onto the photosensitive elements 2Y, 2M, 2C, and 2Bk through a plurality of optical lenses or mirrors while being deflected by a polygon mirror which is driven to rotate by a motor. Instead of the optical writing unit configured as above, an optical writing unit may also be used in which optical scanning using an LED array is performed.

A transfer unit 20 is provided above the process units 1Y, 1M, 1C, and 1Bk to form the Y, M, C, and Bk primary transfer nips by brining the lower stretched surface of an endless intermediate transfer belt 21 into contact with the photosensitive elements 2Y, 2M, 2C, and 2Bk while moving the endless intermediate transfer belt 21 in the counterclockwise direction of the drawing in an endless manner. The Y, M, C, and Bk toner images on the photosensitive elements 2Y, 2M, 2C, and 2Bk are primarily transferred to the intermediate transfer belt 21 in the primary transfer nips of the respective colors in a superimposing manner.

Transfer residual toner stuck to the surfaces of the photosensitive elements 2Y, 2M, 2C, and 2Bk after having passed through the Y, M, C, and Bk primary transfer nips is removed from the surfaces of the photosensitive elements by photosensitive element cleaning units 5Y, 5M, 5C, and 5Bk.

A paper cassette 95 is provided below the optical writing unit 90. A plurality of recording sheets P serving as a recording member are stacked in the paper cassette 95 in a state of a bunch of recording sheets, and a paper feeding roller 95*a* is in contact with the uppermost recording sheet P. If the paper feeding roller 95*a* is driven to rotate in the counterclockwise direction of the drawing by a driving unit (not shown), the uppermost recording sheet P in the paper cassette 95 is discharged toward a feed path which is provided to extend in the vertical direction on the right side of the cassette in the drawing. The recording sheet P fed in the feed path is conveyed from the lower side of the drawing toward the upper side. A process linear speed which is the linear speed of each of the photosensitive elements 2Y, 2M, 2C, and 2Bk or the intermediate transfer belt 21 is set to 120 [mm/sec].

A pair of registration rollers 32 is provided at the end of the feed path. A pair of registration rollers 32 temporarily stops to rotate immediately after the recording sheet P is sandwiched therebetween. Then, the recording sheet P is fed toward a secondary transfer nip with an appropriate timing.

The transfer unit 20 provided above the process units 1Y, 1M, 1C, and 1Bk has primary transfer rollers 25Y, 25M, 25C, and 25Bk, a driven roller 23, a secondary transfer counter roller 24, and the like provided within a belt loop, in addition to the intermediate transfer belt 21. The transfer unit 20 also has a secondary transfer roller 26, a belt cleaning unit 28, and the like provided within the belt loop.

The intermediate transfer belt 21 serving as a nip forming member is an endless belt having a thickness 80 [μm] in which belt base material is made of conductive polyamide-imide resin with carbon dispersed. The volume resistivity of the intermediate transfer belt 21 is adjusted to 1E9 [Ω·cm] (a value measured by Highlester UP MCP HT450 of Mitsubishi Chemical Corporation under a voltage application condition of 100 V). The intermediate transfer belt 21 moves in the counterclockwise direction of the drawing by rotation of at least one roller in an endless manner in a state of being wound around the rollers provided within the belt loop and stretched between the rollers.

The four primary transfer rollers 25Y, 25M, 25C, and 25Bk are arranged so as to press the intermediate transfer belt 21, which moves in an endless manner, to be in contact with the photosensitive elements 2Y, 2M, 2C, and 2Bk. Thus, the Y, M, C, and Bk primary transfer nips are formed where the intermediate transfer belt 21 comes into contact with the photosensitive elements 2Y, 2M, 2C, and 2Bk. The primary transfer rollers 25Y, 25M, 25C, and 25Bk are configured such that a conductive sponge roller portion made of resin with an ion-conductive agent dispersed is provided on the circumferential surface of a metallic rotating shaft member. The volume resistivity of the conductive sponge roller portion is about 5E8 [Ω·cm]. The metallic rotating shaft member is provided at a position deviated to the downstream side of the belt moving direction by 3 [mm] with respect to the rotating shaft of the photosensitive element.

A primary transfer bias having a polarity opposite to the charged polarity of toner is applied from primary transfer power supplies 81Y, 81M, 81C, and 81Bk to the primary transfer rollers 23Y, 23M, 23C, and 23Bk. Thus, a transfer electric field is formed within the primary transfer nip to draw the toner image on the photosensitive element from the photosensitive element toward the belt. While the intermediate transfer belt 21 is sequentially passing through the Y, M, C, and Bk primary transfer nips with the endless movement, the Y, M, C, and Bk toner images on the photosensitive elements 2Y, 2M, 2C, and 2Bk are primarily transferred to the surface (front surface) of the intermediate transfer belt 21 in a superimposing manner. Thus, four colors are superimposed on the intermediate transfer belt 21 to form toner images (hereinafter, referred to as four-color toner images).

The secondary transfer counter roller 24 which is provided inside the belt loop is provided such that the intermediate transfer belt 21 is sandwiched between the secondary transfer counter roller 24 and the secondary transfer roller 26 which is provided outside the belt loop. Thus, a secondary transfer nip where the front surface of the intermediate transfer belt 21 comes into contact with the secondary transfer roller 26 is formed on the right side of the belt in the drawing. The above-described pair of registration rollers 32 feeds the recording sheet P sandwiched therebetween toward the secondary transfer nip with a timing which can be synchronized with the four-color toner images on the intermediate transfer belt 21.

A secondary transfer bias having a polarity opposite to toner is applied to the secondary transfer roller 26. The four-color toner images on the intermediate transfer belt 21 are secondarily transferred collectively to the recording sheet P within the secondary transfer nip by the action of the secondary transfer bias or nip pressure. The four-color toner images become a full color toner image in combination with white of the recording sheet P.

Transfer residual toner which has not been transferred to the recording sheet P is stuck to the intermediate transfer belt 21 after having passed through the secondary transfer nip. Transfer residual toner is cleaned by the belt cleaning unit 28. The belt cleaning unit 28 brings a cleaning roller into contact with the front surface of the intermediate transfer belt 21, such that transfer residual toner on the belt is electrostatically transferred to the cleaning roller and removed.

A fixing unit 40 is provided above the secondary transfer nip. The fixing unit 40 is configured such that a fixing roller 41 having an internal heat generation source, such as a halogen lamp, is pressed to be in contact with a pressing roller 42 to form a fixing nip. The recording sheet P having passed through the secondary transfer nip is separated from the intermediate transfer belt 21 and fed in the fixing unit 40. The recording sheet P is heated or pressed by the fixing roller 41 when conveyed from the lower side of the drawing toward the upper side in a state of being sandwiched in the fixing nip of the fixing unit 40, such that the full color toner image is fixed.

The recording sheet P subjected to fixing processing in the above-described manner is out of the fixing unit 40 and discharged outside the machine through a pair of discharging rollers (not shown).

Of the four Y, M, C, and Bk primary transfer nips, in the Y primary transfer nip on the uppermost stream side of the belt moving direction, the Y toner image on the photosensitive element 2Y is transferred to the intermediate transfer belt 21 to which no toner image is transferred. That is, in the Y primary transfer nip, a first transfer step is carried out in which no superimposing transfer is performed. On the other hand, in the M, C, and Bk primary transfer nips, a second transfer step is carried out in which the toner image on the photosensitive element is transferred to be superimposed on the toner image which has already been transferred to the intermediate transfer belt 21.

Figure 2:
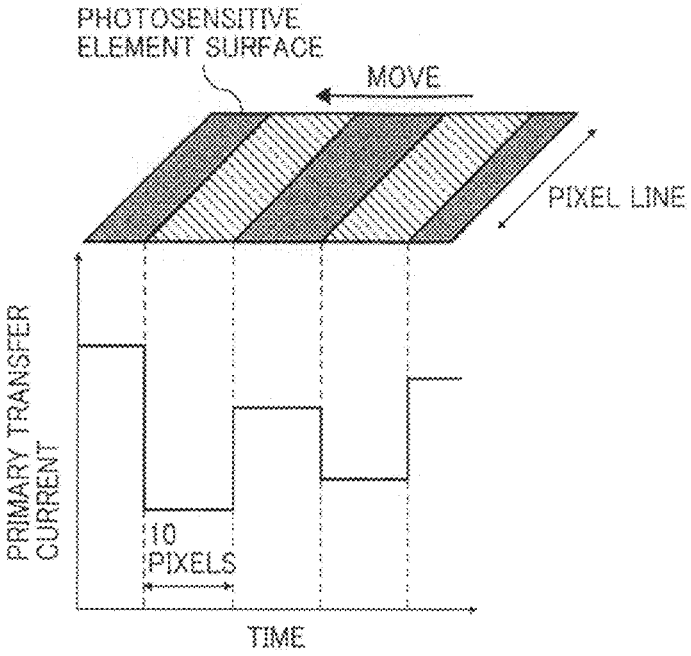
FIG. 2 is a schematic view illustrating a ten-line section on a photosensitive element.

Each of the primary transfer power supplies 81Y, 81M, 81C, and 81Bk which apply a transfer bias to the intermediate transfer belt 21 serving as a nip forming member through the Y, M, C, and Bk primary transfer rollers 25Y, 25M, 25C, and 25Bk outputs a transfer current having the same value as a predetermined target value. The target value of the transfer current which is output from each of the primary transfer power supplies 81Y, 81M, 81C, and 81Bk is determined based on an image area ratio in the main-scanning direction (the axis direction of the photosensitive element) of the toner image on the photosensitive element at and around the exit of the transfer nip. Specifically, as shown in FIG. 2, the surface of the photosensitive element is theoretically divided by ten pixels with reference to on the head of the page in the sub-scanning direction (the moving direction of the surface of the photosensitive element). In each divided section (hereinafter, referred to as "ten-line section"), ten pixel lines, each of which is a collection of pixels arranged linearly in the main-scanning direction, are included. For each pixel line, the ratio of the number of pixels of an image portion to the total number of pixels is obtained as an image area ratio. The average value of the image area ratios of the ten pixel lines is obtained as an average image area ratio in the "ten-line section." The target value of the primary transfer current is determined based on the average image area ratio of the "ten-line section," which is passing through the exit of the transfer nip, from among a plurality of "ten-line sections." While the "ten-line section" is passing through the exit of the primary transfer nip, the output voltage value from the primary transfer power supply (81Y, 81M, 81C, or 81Bk) is adjusted so as to be the same output value as the target value. If the lowermost stream-side pixel line in the "ten-line section" has passed through the exit of the transfer nip, the target value of the transfer current from the primary transfer power supply is changed based on the average image area ratio of the next "ten-line section."

The reason why the target value of the primary transfer current is determined based on the average image area ratio around the exit of the primary transfer nip is as follows. That is, most of a current which flows between the photosensitive element and the intermediate transfer belt 21 is due to separating discharge between the photosensitive element and the intermediate transfer belt 21 at the exit of the primary transfer nip where the photosensitive element and the intermediate transfer belt 21 are separated from each other. At the exit of the primary transfer nip, although the amount of current supply from the primary transfer power supply (81Y, 81M, 81C, or 81Bk) is comparatively small, if the image area ratio of the photosensitive element is comparatively low, most of a current supplied from the primary transfer power supply is used in separating discharge between the non-image portion of the photosensitive element and the belt. Then, a current scarcely flows in the image portion of the photosensitive element, causing defective transfer. The transfer current depending on the average image area ratio around the exit of the primary transfer nip flows, such that an appropriate current flows in the image portion of the photosensitive element and photosensitive element, and it becomes possible to reduce the potential difference between the image portion and the belt to be smaller than the discharge start voltage.

Figure 3:
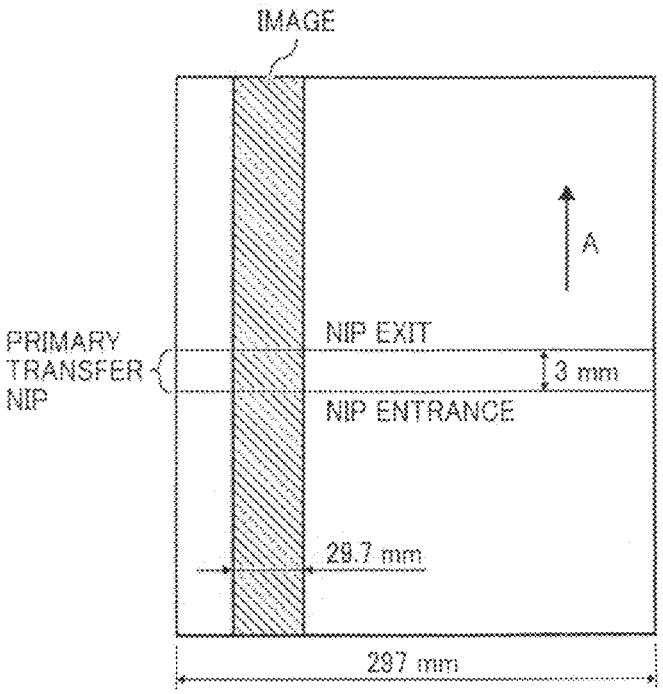
FIG. 3 is a schematic view showing an example of a recording sheet and an image formed thereon.

FIG. 3 is a schematic view showing an example of a recording sheet and an image formed on the recording sheet. The recording sheet shown in the drawing is an A4-size plain sheet and is conveyed inside the printer in a direction indicated by an arrow A in the drawing. Within the primary transfer nip, the arrow A direction is the same direction as the sub-scanning direction. On the recording sheet, a strip-shaped image is formed to extend in the sub-scanning direction. The length of the image in the main-scanning direction (the left-right direction in the drawing) is 29.7 [mm]. The width of the A4-size recording sheet is 297 [mm]. The image extends over the entire region of the recording sheet in the sub-scanning direction. Thus, the image area ratio is constant to be 10%, regardless of the position in the sub-scanning direction. That is, in outputting the image shown in the drawing, the average image area ratio becomes 10% in the "ten-line section" which is moved into the exit of the primary transfer nip. Thus, in outputting the image, a constant primary transfer current continues to be output from the leading edge of the image to the trailing edge, unlike the current waveform of FIG. 2.

Figure 4:
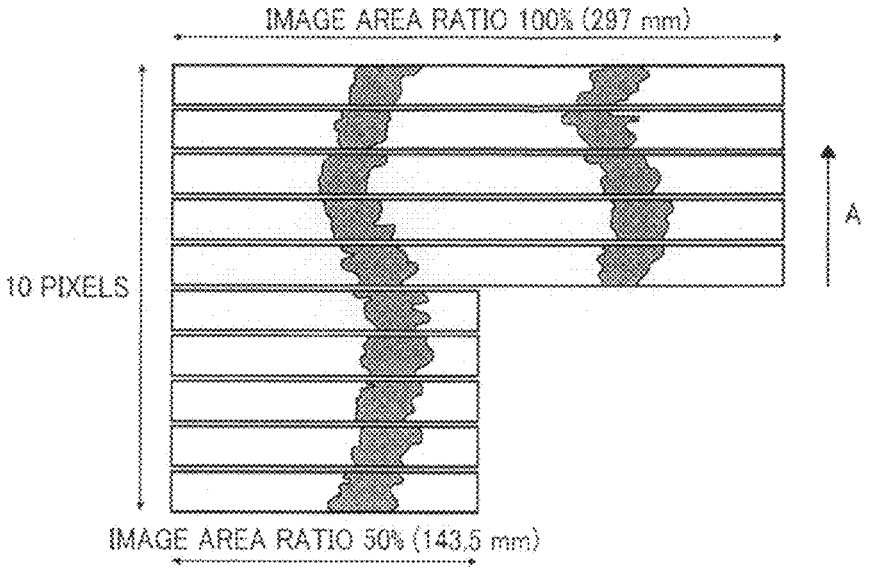
FIG. 4 is a partially enlarged schematic view showing an image different from FIG. 3.

FIG. 4 is a partially enlarged schematic view showing an image different from FIG. 3. In this image, the length in the main-scanning direction is not constant and varies depending on the position in the sub-scanning direction. In an image area shown in the drawing, in five pixel lines from the head in the sub-scanning direction from among ten pixel lines, the image area ratio is 100[%]. On the other hand, in five pixel lines at the trailing edge, the image area ratio is 50[%]. In this "ten-line section," since the average image area ratio becomes 75[%], the target value of the primary transfer current is determined to be a value based on 75[%]. In this embodiment, the calculation of the average image area ratio is done based on a laser write signal in the optical writing unit.

Next, description will be provided as to experiments which have been conducted by the inventors.

EXPERIMENT A

The inventors have prepared a printer tester having the same configuration as the printer according to the embodiment shown in FIG. 1. In this printer tester, an experiment was conducted in which three types of test images were output to find a relationship between a primary transfer current, a primary transfer voltage, a primary transfer rate, and a reverse transfer rate. Specifically, as one image of the three types of test images, a strip-shaped test image with Bk 5% (image area ratio 5%) was printed which has the length in the main-scanning direction of 14.85 [mm] and extends in the lengthwise direction of the A4-size sheet over the entire region in the sub-scanning direction. With regard to the output voltage from the Bk primary transfer power supply 81Bk, constant voltage control was performed to output a constant voltage. The control target value of the voltage was gradually raised from 1000 [V] to 2300 [V] by 100 [V], and the test image with Bk 5% was printed with each control target value. Then, in each printing, the output current value from the Bk primary transfer power supply 81Bk was measured. The stuck toner amount per unit area for the test image with Bk 5% in the Bk photosensitive element 2Bk before being moved into the Bk primary transfer nip and the stuck toner amount per unit area in the photosensitive element 2Bk after having passed through the primary transfer nip were measured. Then, the ratio of the value obtained by subtracting the latter stuck toner amount from the former stuck toner amount to the former stuck toner amount was calculated as a primary transfer rate.

As another image of the three types of test images, a test image with Bk 100% (image area ratio 100%) which was stuck to an A4-size sheet in a solid shape over the entire surface was printed. As yet another image, a test image with M 100%+Bk 5% was printed in which a test image with Bk 5% was superimposed on a test image with M 100% which was stuck to an A4-size sheet in a solid shape over the entire surface. For these test images, similarly to the test image with Bk 5%, the control target value of the voltage was gradually raised from 1000 [V] to 2300 [V] by 100 [V], and the primary transfer current value and the primary transfer rate were measured under the respective conditions. For the test image with M 100%+Bk 5%, the stuck toner amount of M toner reversely transferred to the non-image portion of the photosensitive element 2Bk after having passed through the Bk primary transfer nip was measured, and the ratio of the measurement result to the amount at the time of being moved into the nip was obtained as an M toner reverse transfer rate. The stuck toner amount was measured based on the spectroscopic measurement result by a reflection spectrodensitometer X-Rite 938.

Figure 5:
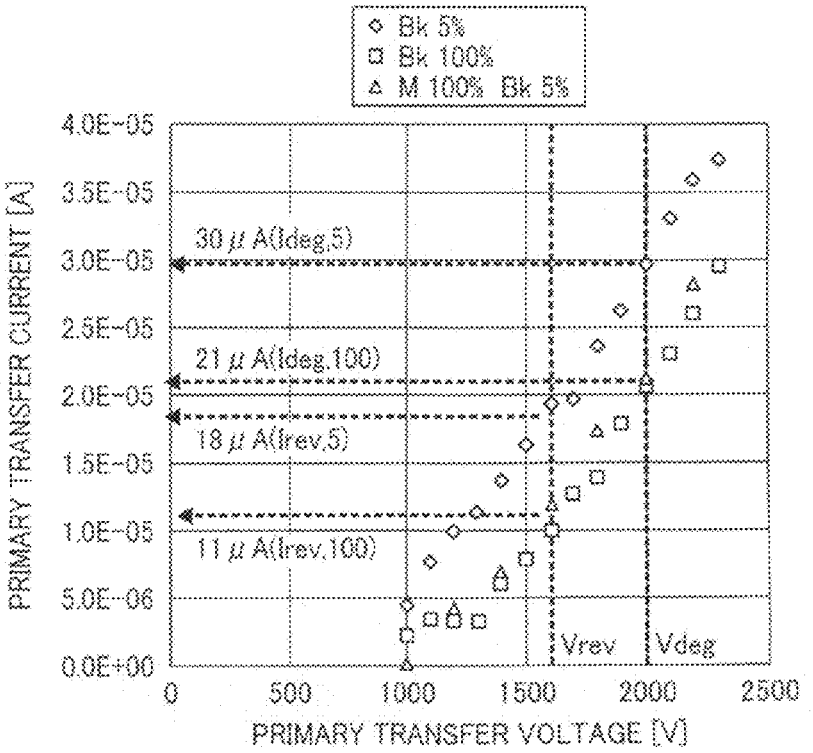
FIG. 5 is a graph showing a relationship between a primary transfer voltage, a primary transfer current, and a test image in Experiment A.
Figure 6:
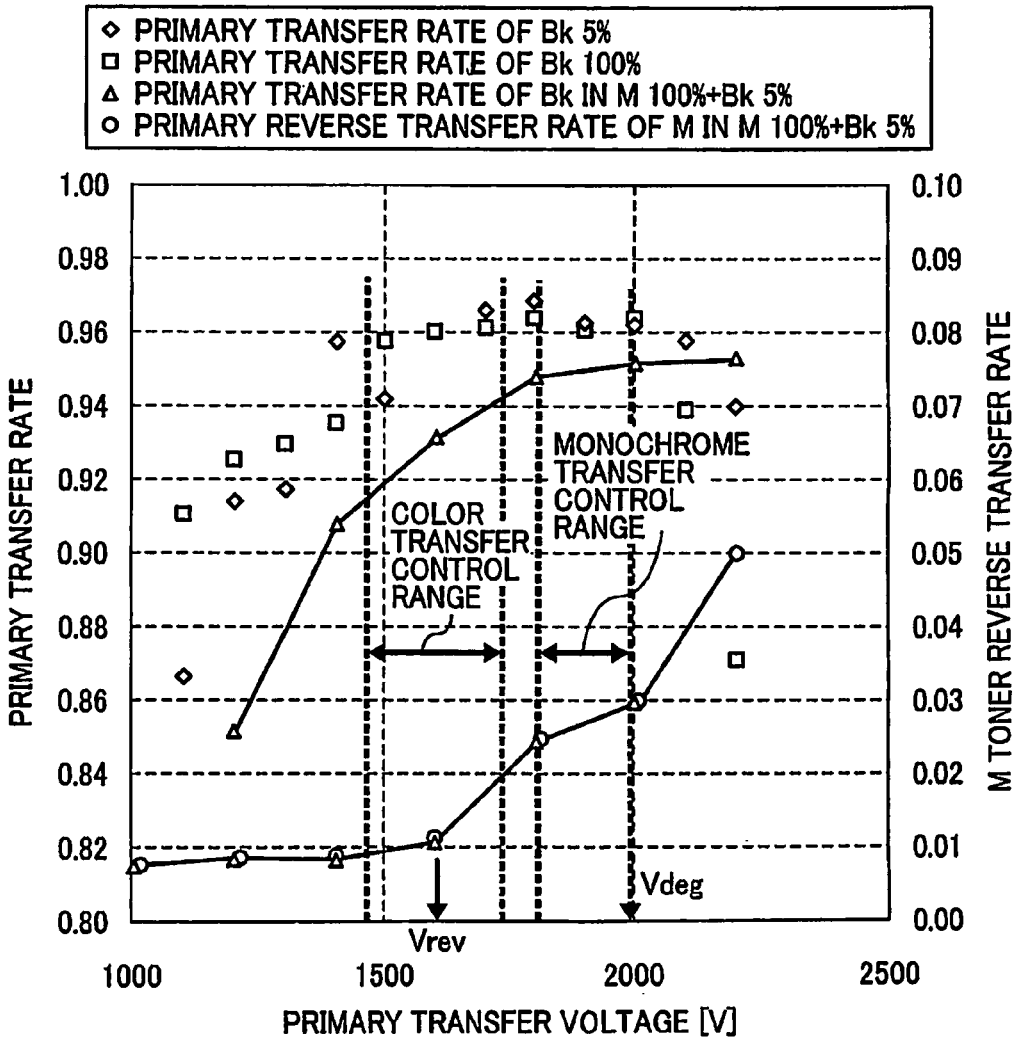
FIG. 6 is a graph showing a relationship between a primary transfer rate, a primary transfer voltage, an M toner reverse transfer rate, and a test image in Experiment A.
Figure 7:
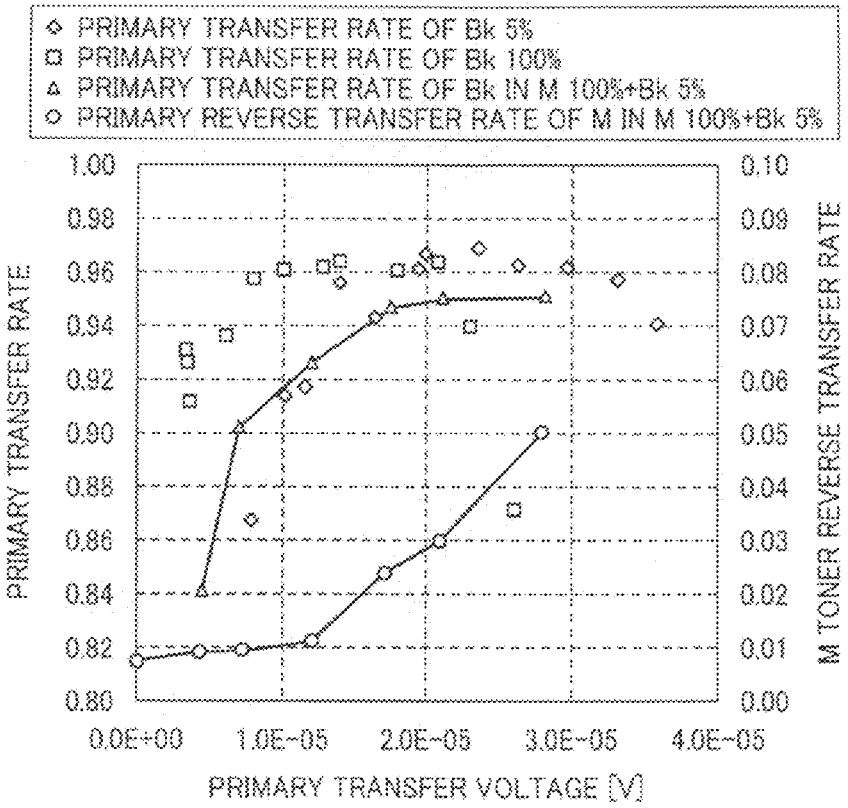
FIG. 7 is a graph showing a relationship between a primary transfer rate, a primary transfer current, an M toner reverse transfer rate, and a test image in Experiment A.

FIG. 5 is a graph showing a relationship between a primary transfer voltage, a primary transfer current, and a test image in Experiment A. FIG. 6 is a graph showing a relationship between a primary transfer rate, a primary transfer voltage, an M toner reverse transfer rate, and a test image in Experiment A. FIG. 7 is a graph showing a relationship between a primary transfer rate, a primary transfer current, an M toner reverse transfer rate, and a test image in Experiment A.

As shown in FIG. 6, when a monochrome toner image made of Bk only is formed as a test image (Bk 5% or Bk 100%), if the primary transfer voltage exceeds a predetermined value, the primary transfer rate starts to be rapidly lowered, regardless of the image area ratio. Specifically, if the primary transfer voltage exceeds 2000 [V], the primary transfer rate starts to be rapidly lowered. In this specification, the predetermined value is called a critical transfer rate voltage Vdeg. The critical transfer rate voltage Vdeg is the same value as a previous target value which causes the transfer rate to be continuously lowered twice in an experiment in which the transfer rate is measured while the output voltage target value of the transfer bias subjected to constant voltage control is gradually raised by 100 [V]. In the monochrome test image of the image area ratio 5% and the monochrome test image of the image area ratio 100%, it is necessary that the relationship between the transfer voltage and the transfer rate is found and the above-described phenomenon is observed with each image area ratio. For example, referring to FIG. 6, when the primary transfer bias is in a range of 1000 to 1800 [V], with the image area ratios 5% and 100%, the primary transfer voltage is raised and the transfer rate is also raised. Then, if the primary transfer voltage is 1900 [V], with each image area ratio, the primary transfer rate is lowered to less than the condition of 1800 [V]. If the primary transfer voltage is 2000 [V], in the image of the image area ratio 5%, the primary transfer rate is lowered to less than 1900 [V] and, in the image of the image area ratio 100%, the primary transfer rate is raised to more than 1900 [V]. Thus, 1800 [V] is not the critical transfer rate voltage Vdeg. With the image area ratios 5% and 100%, the primary transfer rate is continuously lowered twice when the primary transfer voltage is raised in order of 2100 and 2200 [V]. The critical transfer rate voltage Vdeg is 2000 [V] which comes right before 2100 [V].

Under the condition of the critical transfer rate voltage Vdeg of 2000 [V], as shown in FIG. 5, a current which flows in the primary transfer nip differs depending on the image area ratio. Specifically, in the case of the test image with Bk 5%, the primary transfer current of 30 [μA] is output from the primary transfer power supply 81Bk under the condition of Vdeg=2000 [V]. Meanwhile, in the case of the test image with Bk 100%, the primary transfer current of 21 [μA] is output from the primary transfer power supply 81Bk under the condition Vdeg=2000 [V]. As described above, when the primary transfer bias is subjected to constant voltage control, as the image area ratio of the photosensitive element is lowered, more primary transfer current flows. This is because, under the condition of constant voltage control in which the primary transfer voltage is controlled to be constant, as the image area ratio is lowered, the amount of charges of the photosensitive element becomes greater so that more current flows between the belt and the photosensitive element. For example, in the printer tester, the Bk photosensitive element 2Bk is uniformly charged with about −500 [V] by the charging unit. With regard to the image portion (electrostatic latent image), laser light L is irradiated such that the potential of −500 [V] is attenuated to about −30 [V]. As the photosensitive element 2Bk, a photosensitive element having electrostatic capacitance of 9.5E-7 [F/m$^2$] is used. Thus, the area charge density of the non-image portion of the photosensitive element 2Bk is about −475 [μC/m$^2$]. Meanwhile, the area charge density of the image portion of the photosensitive element 2Bk is the sum of the charge quantity of toner of 0.45E-3 [g/cm$^2$]×−20 [μC/g]=−0.009 [μC/cm$^2$]=−90 [μC/m$^2$] and the charge quantity (−29 μC/m$^2$) of a residual potential (about −30 [V]) of the photosensitive element, that is, about −119 [μC/m$^2$]. In the photosensitive element 2Bk, the charge quantity of the non-image portion is four times larger than that of the image portion. For this reason, in the primary transfer nip, an electric field which is formed between the non-image portion of the photosensitive element 2Bk and the intermediate transfer belt 21 is stronger than an electric field which is formed between the image portion of the photosensitive element 2Bk and the intermediate transfer belt 21. When this happens, the smaller the image area ratio of the photosensitive element 2Bk, the more a current is likely to flow between the belt and the photosensitive element. Thus, the output current increases such that the output voltage value from the primary transfer power supply 81Bk becomes a predetermined value.

As described above, in the case of constant voltage control, although the smaller the image area ratio, the larger the output current value from the power supply, even with the same image area ratio, the output current value significantly differs depending on the environment. This is because, if the environment is changed, the resistance value of the intermediate transfer belt 21 or the primary transfer roller 25Bk is also changed. For this reason, under the condition of constant voltage control, even when the target value of the output voltage varies depending on the image area ratio, the primary transfer current is excessive or lacking depending on the environment, causing defective transfer. Thus, it is advantageous that the primary transfer bias is subjected to constant current control, not constant voltage control. It is also preferable that the target value of the output current varies depending on the image area ratio, not simple constant current control.

In the Y primary transfer nip, as the target value of the primary transfer current, it is preferable to use a value for obtaining as high transfer efficiency as possible because of the following reason. That is, the Y toner image sequentially passes through all the M, C, and Bk primary transfer nips, and toner is stuck to the photosensitive element just a little and lost each time. For this reason, the Y toner image is likely to be reduced in thickness compared to the toner image of other colors. Thus, with regard to the target value of the output current from the Y primary transfer power supply 81Y, it is preferable to set a value such that the output voltage becomes the critical transfer rate voltage Vdeg. Experiment A is conducted in the environment of 25[° C.]. Under this condition, if the target value of constant voltage control is set to 2000 [V] which is the same as the critical transfer rate voltage Vdeg, as shown in FIG. 5, in the test image with Bk 5%, the primary transfer current of 30 [μA] flows and, in the test image with Bk 100%, the primary transfer current of 21 [μA] flows. In the case of simple constant voltage control, if the room temperature is changed from 25[° C.] and the resistance of the belt or the roller is changed, even when the primary transfer voltage is maintained at 2000 [V], the primary transfer current is excessive or lacking. This is because the value of 2000 [V] is the critical transfer rate voltage Vdeg in the environment of 25[° C.], and if the room temperature is changed from 25[° C.], the value of the critical transfer rate voltage Vdeg is also changed. On the other hand, a critical transfer rate current Ideg is constant without depending on the environment. Specifically, when the image area ratio is 5%, the value of the primary transfer current is maintained constant at the critical transfer rate current Ideg,5=30 [μA] without depending on the environment, maintaining a state where primary transfer efficiency increases to the limit (a state where the output voltage is set to the critical transfer rate voltage Vdeg). When the image area ratio is 100%, the value of the primary transfer current is maintained constant at the critical transfer rate current Ideg,100=21 [μA], maintaining a state where the output voltage is set to the critical transfer rate voltage Vdeg.

As described above, with regard to the Y primary transfer power supply 81Y, it is preferable that constant current control is performed with the critical transfer rate current Ideg, 5=30 [μA] as the target value when the image area ratio is 5% and with the critical transfer rate current Ideg,100=21 [μA] as the target value when the image area ratio is 100%. Meanwhile, if the same constant current control is performed in the M, C, and Bk primary transfer power supplies 81M, 81C, and 81Bk, it could be seen that, in each of the M, C, and Bk primary transfer nips, Y toner on the belt is reversely transferred easily to the non-image portion of each of the photosensitive elements 2M, 2C, and 2Bk.

For example, as shown in FIG. 6, in the Bk primary transfer nip, the reverse transfer rate (M toner reverse transfer rate) of the toner image with M 100% on the belt to the non-image portion of the photosensitive element 2Bk significantly increases depending on the value of the primary transfer voltage. Specifically, it can be seen that, while the M toner reverse transfer rate is less than 0.01[%] under the condition that the primary transfer voltage is set to 1000 to 1500 [V], if the primary transfer voltage becomes higher than 1600 [V], the M toner reverse transfer rate starts to rapidly increase.

If the primary transfer voltage exceeds the above-described critical transfer rate voltage Vdeg, the primary transfer rate starts to rapidly decrease. The reason is considered as follows. That is, in forming a monochrome image, if the primary transfer voltage exceeds the critical transfer rate voltage Vdeg, the potential difference between the image portion of −30 [V] in the photosensitive element and the intermediate transfer belt 21 exceeds the discharge start voltage. When this happens, within the primary transfer nip, discharge is actively generated between the image portion (−30 V) of the photosensitive element and the intermediate transfer belt 21, such that toner on the image portion is reversely charged due to the discharge. With this reverse charge, toner on the image portion is not electrostatically moved onto the intermediate transfer belt 21 and remains on the image portion. It is considered that this causes a decrease in the primary transfer rate.

When the decrease in the primary transfer rate occurs, within the primary transfer nip, discharge is generated between the non-image portion of −500 [V] of the photosensitive element and the belt as well as between the image portion of −30 [V] of the photosensitive element and the belt. Meanwhile, in printing a monochrome image, within the primary transfer nip, the toner image on the photosensitive element is transferred to the intermediate transfer belt 21 on which there is no toner image. Thus, toner is not interposed between the non-image portion of the photosensitive element and the belt. For this reason, there is no case where a phenomenon of discharge between the non-image portion and the belt appears as an outward phenomenon. Focusing on the image portion (−30 V) of the photosensitive element where a phenomenon of the decrease in the primary transfer rate appears as an outward phenomenon, if the output voltage from the primary transfer power supply becomes higher than 2000 [V], the potential difference between the image portion of the photosensitive element and the belt becomes higher than the discharge start voltage. It is difficult to recognize the surface potential of the belt. Thus, for convenience, taking into consideration the output voltage from the primary transfer power supply, in Experiment A, if the potential difference between the output voltage and the photosensitive element becomes higher than 2030 [V], the potential difference between the photosensitive element and the belt becomes higher than the discharge start voltage.

On the other hand, as described above, in Experiment A, if the output voltage from the Bk primary transfer power supply 81Bk becomes higher than 1600 [V], the M toner reverse transfer rate starts to rapidly increase. The reason why the rapid increase is recognized is considered as follows. That is, in printing a multi-color image with two or more colors superimposed as well as a monochrome image, in the primary transfer nip for the second color and the latter colors, the toner image which has already been transferred to the belt is interposed between the non-image portion of the subsequent photosensitive element and the belt. At this time, if the potential difference between the non-image portion (−500 V) of the photosensitive element and the output voltage from the primary transfer power supply is higher than 2030 [V], discharge is generated between the non-image portion and the intermediate transfer belt 21. Then, toner in the toner image which has already been transferred to the intermediate transfer belt 21 is reversely charged due to the discharge and reversely transferred to the non-image portion of the photosensitive element. The potential of the non-image portion of the photosensitive element is about −500 [V]. Thus, if the output voltage from the primary transfer power supply becomes higher than 1530 [V], reverse transfer occurs. In Experiment A, the output voltage is raised by 100 [V], such that 1530 [V] corresponds to the condition of 1600 [V]. For this reason, in the graph of FIG. 6, it is considered that, if the primary transfer voltage exceeds 1600 [V], the M toner reverse transfer rate starts to rapidly increase.

Under the condition of room temperature 25[° C.], as described above, when the primary transfer current of the critical transfer rate current Ideg (Ideg,5=30 μA in the 5% image, Ideg,100=21 μA in the 100% image) flows, the critical transfer rate voltage Vdeg becomes about 2000 [V]. It is assumed that this control of the primary transfer current is performed in the M, C, and Bk primary transfer power supplies 81M, 81C, and 81Bk as well as the Y primary transfer power supply 81Y. When this happens, within each of the M, C, and Bk primary transfer nips, the potential difference between the non-image portion of the photosensitive element and the intermediate transfer belt becomes higher than the discharge start voltage, such that toner on the belt is reversely transferred to the non-image portion of the photosensitive element.

However, in the M, C, and Bk primary transfer nips, at the time of a first color transfer step in multi-color superimposing transfer, similarly to Y, even when the primary transfer voltage is raised to the critical transfer rate voltage Vdeg, there is no problem. This is because, at the time of the first color transfer step, there is no toner image on the intermediate transfer belt 21. For example, in the case of a two-color toner image in which M and C are superimposed, the first color transfer step is carried out in the M primary transfer nip. At this time, there is no toner image on the belt.

In the second color and the latter colors transfer step, from the viewpoint of an appropriate primary transfer voltage, it should suffice that the potential difference from the image portion (−500 V) of the photosensitive element is set to a value lower than 2030 [V]. This is because the potential difference between the image portion and the belt can be set to be lower than the discharge start voltage. In Experiment A, this value corresponds to about 1600 [V]. This value corresponds to a value which is obtained by rounding lower two digits from a value obtained by subtracting the potential difference (430) between the non-image portion of the photosensitive element and the image portion from the critical transfer rate voltage Vdeg at 25[° C.]. Hereinafter, this value is called a reverse transfer avoidance upper limit voltage Vrev.

Similarly to the critical transfer rate voltage Vdeg, the value of the reverse transfer avoidance upper limit voltage Vrev differs depending on the environment. Meanwhile, with the image area ratio 100%, a reverse transfer avoidance upper limit current Irev,100 which is the primary transfer current value for realizing the reverse transfer avoidance upper limit voltage Vrev is constant without depending on the environment. Specifically, as shown in FIG. 5, in the case of the image area ratio 100%, the value of the primary transfer current is maintained constant to the reverse transfer avoidance upper limit current Irev,100=21 [μA] without depending on the environment, maintaining a state where the output voltage is set to the critical transfer rate voltage Vdeg.

EXPERIMENT B

An experiment was conducted in which a test image was printed by using only the Y process unit 1Y of the printer tester or the M process unit 1M, or by using both the Y process unit 1Y and the M process unit 1M, and the primary transfer rate or the reverse transfer rate was measured. In the Y primary transfer nip or the M primary transfer nip, the primary transfer current was subjected to constant current control under the conditions shown in Table 1.

TABLE 1

| | Y Primary Transfer Nip | | M Primary Transfer Nip | |
|---|---|---|---|---|
| Experiment No. | Target Value [μA] of Primary Transfer Current | Measured Value [V] of Primary Transfer Voltage | Target Value [μA] of Primary Transfer Current | Measured Value [V] of Primary Transfer Voltage |
| 1 | 18 (100%) to 27 (5%) | about 1900 | 3 (100%) to 11 (5%) | about 1280 |
| 2 | 18 (100%) to 27 (5%) | about 1900 | 7 (100%) to 15 (5%) | about 1440 |
| 3 | 18 (100%) to 27 (5%) | about 1900 | 11 (100%) to 18 (5%) | about 1600 |
| 4 | 18 (100%) to 27 (5%) | about 1900 | 16 (100%) to 23 (5%) | about 1760 |
| 5 (Related Art) | 18 (100%) to 27 (5%) | about 1900 | 18 (100%) to 27 (5%) | about 1900 |

With regard to any of Experiment Nos. 1 to 5, in this experiment B, the primary transfer current was subjected to constant current control in the Y primary transfer nip as the first-color transfer step. That is, in order that the output voltage from the primary transfer power supply 81Y is set to about 1900 [V], constant current control was performed with the target value 27 [μA] when the average image area ratio is 5[%], and constant current control was performed with the target value 18 [μA] when the average image area ratio is 100[%]. When the average image area ratio is greater than 5[%] and smaller than 100[%], the target value corresponding to the average image area ratio was selected based on a line which passes through a 5%, 27 μA plot point and passes through a 100%, 18 μA plot point, and constant current control was performed. The output voltage is set to about 1900 [V] because the output voltage has to be set to a value smaller than critical transfer rate voltage Vdeg by 5[%] under the environment of 25[° C.]. According to the experiment of the inventors, even when the output voltage is set to a value smaller than the critical transfer rate voltage Vdeg by 10[%], good primary transfer efficiency was obtained. Thus, with regard to Y, the target value is set for each average image area ratio such that the output voltage value is in a range of the critical transfer rate voltage Vdeg−0.1×the critical transfer rate voltage Vdeg to the critical transfer rate voltage Vdeg, realizing excellent primary transfer efficiency in the Y toner image.

Of Experiment Nos. 1 to 5, in the case of Experiment No. 5, the same value as the target value of the Y primary transfer current was selected as the target value of the M primary transfer current. This corresponds to the related art. Meanwhile, in the case of Experiment Nos. 1 to 4, a value smaller than the target value of the Y primary transfer current was selected as the target value of the M primary transfer current with the same image area ratio.

Specifically, in the case of Experiment No. 1, the following constant current control was performed for the M primary transfer power supply 81M. That is, when the average image area ratio of M on the photosensitive element is 5[%], the target value 11 [μA] was selected and, when the average image area ratio is 100[%], the target value 3 [μA] was selected, such that the output voltage when no Y toner image exists on the belt is set to about 1280 [V] without depending on the environment. Then, constant current control was performed. When the average image area ratio is greater than 5[%] and smaller than 100[%], the target value corresponding to the average image area ratio was selected based on a line which passes through a 5%, 11 μA plot point and passes through 100%, 3 μA plot point, and constant current control was performed.

In the case of Experiment No. 2, the following constant current control was performed for the M primary transfer power supply 81M. That is, when the average image area ratio of M on the photosensitive element 2M is 5[%], the target value 15 [μA] was selected and, when the average image area ratio is 100[%], the target value 7 [μA] was selected, such that the output voltage when no Y toner image exists on the belt is set to about 1440 [V] (1600−1600×0.1) without depending on the environment. Then, constant current control was performed. When the average image area ratio is greater than 5[%] and smaller than 100[%], the target value corresponding to the average image area ratio was selected based on a line which passes through a 5%, 15 μA plot point and passes through 100%, 7 μA plot point, and constant current control was performed.

In the case of Experiment No. 3, the following constant current control was performed for the M primary transfer power supply 81M. That is, when the average image area ratio of M on the photosensitive element 2M is 5[%], the target value 18 [μA] was selected and, when the average image area ratio is 100[%], the target value 11 [μA] was selected, such that the output voltage when no Y toner image exists on the belt is set to about 1600 [V] without depending on the environment. Then, constant current control was performed. When the average image area ratio is greater than 5[%] and smaller than 100[%], the target value corresponding to the average image area ratio was selected based on a line which passes through a 5%, 18 μA plot point and passes through a 100%, 11 μA plot point, and constant current control was performed.

In the case of Experiment No. 4, the following constant current control was performed for the M primary transfer power supply 81M. That is, when the average image area ratio on the photosensitive element 2M is 5[%], the target value 23 [μA] was selected and, when the average image area ratio was 100[%], the target value was 16 [μA] was selected, such that the output voltage when no Y toner image exists on the belt is set to about 1760 [V] (1600+1600×0.1) without depending on the environment. Then, constant current control was performed. When the average image area ratio is greater than 5[%] and smaller than 100[%], the target value corresponding to the average image area ratio was selected based on a line which passes through a 5%, 23 μA plot point and passes through 100%, 16 μA plot point, and constant current control was performed.

With regard to the target value of the C or Bk primary transfer power supply 81C or 81Bk, 11 [μA] was selected as a value such that no reverse transfer occurs. The target value was made constant, 11 [μA], regardless of the image area ratio.

Under the conditions of Experiment Nos., nine types of test images were output. Specifically, an M monochrome image with an image area ratio 5% was printed as a first test image. An M monochrome image with an image area ratio 100% was printed as a second test image. With regard to these M monochrome images, the primary transfer rate in the M primary transfer nip was measured.

A YM superimposed image (YM perfect matching) in which an M image with an image area ratio 5% was transferred to a Y image with an image area ratio 5% in a superimposing manner in the M primary transfer nip so as to perfectly match with each other was printed as a third test image. A YM superimposed image (YM perfect matching) in which an M solid image with an image area ratio 5% was transferred to a Y solid image with an image area ratio 100% in a superimposing manner in the M primary transfer nip so as to perfectly match with each other was printed as a fourth test image. With regard to these YM superimposed images, the M primary transfer rate in the M primary transfer nip was measured.

A Y monochrome image with an image area ratio 5% was printed as a fifth test image. A Y monochrome image with an image area ratio 100% was printed as a sixth test image. With regard to these Y monochrome images, the reverse transfer rate with respect to the non-image portion of the photosensitive element 2M in the M primary transfer nip was measured.

A YM superimposed image in which an M image with an image area ratio 5% was transferred to a Y image with an image area ratio 5% in a superimposing manner in the M primary transfer nip so as to perfectly match with each other was printed as a seventh test image. A YM superimposed image in which an M image with an image area ratio 5% was transferred to a Y image with an image area ratio 100% in a superimposing manner in the M primary transfer nip was printed as an eighth test image. With regard to these YM superimposed images, the reverse transfer rate of Y toner with respect to the non-image portion of the photosensitive element 2M in the M primary transfer nip was measured.

A Y-alone+M-alone image in which an M monochrome image with an image area ratio 95% was printed in parallel lateral to a Y monochrome image with an image area ratio 5% was printed as a ninth test image. With regard to this Y-alone+M-alone image, the reverse transfer rate of Y toner with respect to non-image portion of the photosensitive element·2M in the M primary transfer nip was measured.

In the respective test images, the stuck toner amount for obtaining the primary transfer rate or the reverse transfer rate was measured by using a reflection spectrodensitometer X-Rite 938. The experiment result of this experiment B is shown in Table 2.

TABLE 2

| | Image | | | | | | | | |
|---|---|---|---|---|---|---|---|---|---|
| | M Monochrome Image | | YM Superimposed (YM Perfect Matching) | | Y Monochrome Image | | YM Superimposed | | Y-Alone + M-Alone |
| | Transfer Nip | | | | | | | | |
| | M Transfer Nip | | M Transfer Nip | | M Transfer Nip | | M Transfer Nip | | M Transfer Nip |
| | Measurement Item | | | | | | | | |
| | M Primary Transfer Rate | | M Primary Transfer Rate | | Y Reverse Transfer Rate | | Y Reverse Transfer Rate | | Y Reverse Transfer Rate |
| | Image Area Ratio | | | | | | | | |
| Experiment No. | 5% (M) | 100% (M) | 5% (Y) 5% (M) | 100% (Y) 100% (M) | 5% (Y) | 100% (Y) | 5% (Y) 5% (M) | 100% (Y) 5% (M) | 5% (Y) 95% (M) |
| 1 | 0.92 | 0.93 | 0.89 | 0.93 | 0.01 | 0.01 | 0.01 | 0.01 | 0.01 |
| 2 | 0.95 | 0.96 | 0.92 | 0.96 | 0.01 | 0.01 | 0.01 | 0.01 | 0.01 |
| 3 | 0.96 | 0.96 | 0.93 | 0.96 | 0.01 | 0.01 | 0.01 | 0.029 | 0.01 |

TABLE 2-continued

| | Image | | | | | | | | |
|---|---|---|---|---|---|---|---|---|---|
| | M Monochrome Image | | YM Superimposed (YM Perfect Matching) | | Y Monochrome Image | | YM Superimposed | | Y-Alone + M-Alone |
| | Transfer Nip | | | | | | | | |
| | M Transfer Nip | | M Transfer Nip | | M Transfer Nip | | M Transfer Nip | | M Transfer Nip |
| | Measurement Item | | | | | | | | |
| | M Primary Transfer Rate | | M Primary Transfer Rate | | Y Reverse Transfer Rate | | Y Reverse Transfer Rate | | Y Reverse Transfer Rate |
| | Image Area Ratio | | | | | | | | |
| Experiment No. | 5% (M) | 100% (M) | 5% (Y) 5% (M) | 100% (Y) 100% (M) | 5% (Y) | 100% (Y) | 5% (Y) 5% (M) | 100% (Y) 5% (M) | 5% (Y) 95% (M) |
| 4 | 0.96 | 0.96 | 0.95 | 0.96 | 0.01 | 0.01 | 0.019 | 0.04 | 0.023 |
| 5 (Related Art) | 0.96 | 0.96 | 0.95 | 0.96 | 0.01 | 0.01 | 0.03 | 0.051 | 0.035 |

As described above, in forming the images with the same image area ratio, in Experiment Nos. 1 to 4, a value smaller than that in Experiment No. 5 is selected as the target value of the primary transfer current. With the same image area ratio, the target value increases in order of Experiment No. 1<Experiment No. 2<Experiment No. 3<Experiment No. 4<Experiment No. 5. In the case of Experiment Nos. 2, 3, and 4, although the primary transfer current is smaller than that in Experiment No. 5 as the related art, the primary transfer rate which is substantially the same as in Experiment No. 5 is obtained. In Experiment No. 1, the primary transfer rate significantly decreases compared to Experiment No. 5. This is because the value of the primary transfer current was excessively small. From Table 2, it could be seen that, in the primary transfer nip for the second color and the latter colors, even when the primary transfer current is made smaller than that in the primary transfer nip for the first color, unless the primary transfer current is made excessively small, the same primary transfer efficiency as the first color can be realized.

In forming the YM superimposed image or the Y-alone+M-alone image, in Experiment No. 5 as the related art, the phenomenon that the Y toner image is reversely transferred to the photosensitive element in the M primary transfer nip is noticeably observed (reverse transfer rate=0.003 to 0.051). In contrast, in all of Experiment Nos. 1 to 4 in which the M primary transfer current is made smaller than Y, the reverse transfer rate is improved compared to Experiment No. 5. This is because the target value of the primary transfer current is made small and the non-image portion of the potential difference between photosensitive element and the belt in the M primary transfer nip becomes smaller, such that discharge is not easily generated between the non-image portion and the belt. In particular, in Experiment Nos. 1 to 3 (see Table 1) in which the output voltage from the M primary transfer power supply 81M is substantially the same as the above-described reverse transfer avoidance upper limit voltage Vrev and is maintained to be equal to or lower than about 1600 [V], the reverse transfer rate is significantly improved compared to Experiment No. 5. This is because the output voltage value is set to be equal to or lower than the reverse transfer avoidance upper limit voltage Vrev, suppressing the occurrence of discharge between the non-image portion of the photosensitive element and the belt in the M primary transfer nip.

EXPERIMENT C

Figure 8:
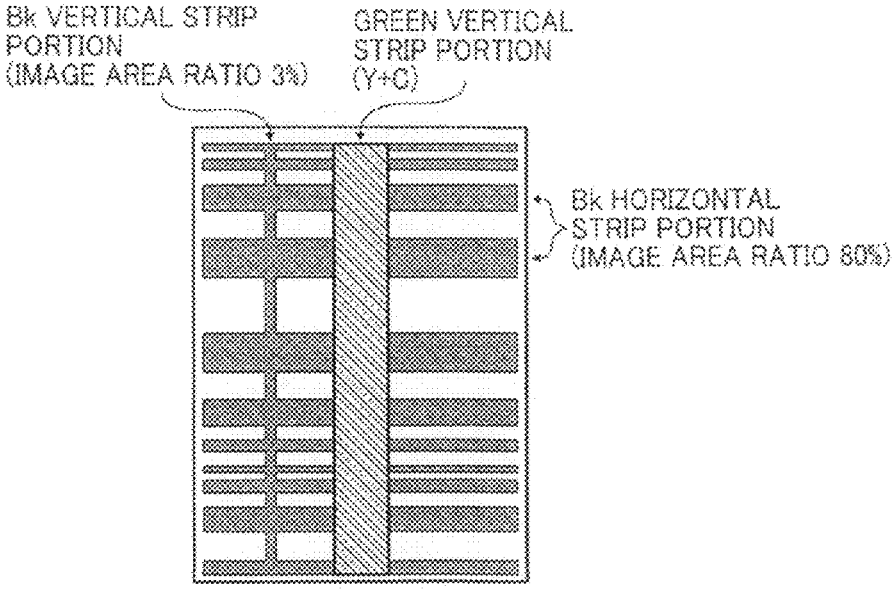
FIG. 8 is a schematic view showing a test image which is printed in Experiment C.

A test image shown in FIG. 8 was printed by the printer tester. The test image is printed on an A3-size recording sheet, and has a plurality of Bk horizontal strip portion, a single Bk vertical strip portion, and a single green vertical strip portion. A plurality of Bk horizontal strip portions has a horizontal long strip shape with an image area ratio 80[%] which extends in the main-scanning direction (the left-right direction in the drawing). A plurality of Bk horizontal strip portions is arranged in parallel with each other in the sub-scanning direction (the up-down direction of the paper in the drawing) at intervals. The Bk vertical strip portion has a vertical long strip shape with an image area ratio 3[%] which extends over the entire image area in the sub-scanning direction. The green vertical strip portion is formed by superimposing a Y vertical strip portion and a C vertical strip portion which having a vertical long strip shape extending over the entire image area in the sub-scanning direction. In printing such a test image, of the four primary transfer nips, in the Bk primary transfer nip on the lowermost stream side, there are the green vertical strip portion formed in the green vertical strip portion in addition to the Bk vertical strip portion or the Bk horizontal strip portion. However, similarly to Experiment B, with regard to the Bk primary transfer bias, the target value of constant current control was changed in accordance with the image area ratio of the Bk vertical strip portion or the Bk horizontal strip portion as the toner image on the photosensitive element 2Bk, regardless of the image area ratio of the green vertical strip portion as the toner image having already been transferred to the belt.

With regard to the Y primary transfer bias, constant current control was performed with the target value=27 [μA] when the average image area ratio on the photosensitive element is 3[%], and constant current control was performed with the target value=18 [μA] when the average image area ratio is 100[%]. When the average image area ratio is greater than 3[%] and smaller than 100[%], the target value corresponding to the average image area ratio was selected based on a line which passes through a 3%, 27 μA plot point and passes through a 100%, 18 μA plot point, and constant current control was performed.

On the other hand, with regard to the C and Bk primary transfer bias, constant current control was performed with the target value=23 [μA] when the average image area ratio on the photosensitive element is 3[%], and constant current control was performed with the target value=16 [μA] when the average image area ratio is 100[%]. When the average image area ratio is greater than 3[%] and smaller than 100[%], the target value corresponding to the image area ratio was selected based on a line which passes through a 3%, 23 μA plot point and passes through a 100%, 16 μA plot point, and constant current control was performed.

Figure 9:
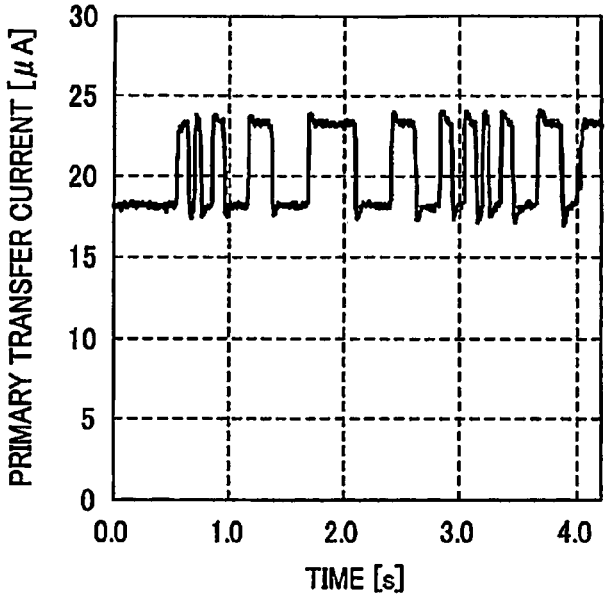
FIG. 9 is a graph showing a temporal change in a primary transfer current in Experiment C.

FIG. 9 is a graph showing a temporal change in the primary transfer current of the Bk primary transfer nip in Experiment C. FIG. 9 shows a temporal change when a test image is moved into the Bk primary transfer nip. As shown in the drawing, it could been seen that the change in the primary transfer current rapidly responds to the change in the average image area ratio on the photosensitive element 2Bk, the average image area ratio is calculated for each "ten-line section," and even when the target value of a current is rapidly changed at the turn of the section, the primary transfer current can be satisfactorily suppressed. In the Bk primary transfer nip, the amount of Y toner or C toner of the green vertical strip portion which was reversely transferred to the non-image portion of the photosensitive element 2Bk was small, and the image density difference ΔE of the green vertical strip portion before and after being moved into the Bk nip could be maintained to be smaller than 1.5 (measured by the reflection spectrodensitometer X-Rite 938). In contrast, when the Bk primary transfer bias was subjected to constant current control so as to be simply constant, 23 [μA], reverse transfer of Y toner or C toner noticeably occurred and the image density difference ΔE of the green vertical strip portion increased to 3.8.

Next, the characteristic configuration of the printer according to the embodiment will be described.

In the printer of the embodiment, the Y primary transfer power supply 81Y is configured to select the target value of the transfer current in accordance with the average image area ratio (the average of the ten pixel lines) on the photosensitive element 2Y and to perform constant current control for the output current such that the output voltage value is substantially stabilized in a range of the critical transfer rate voltage Vdeg or the critical transfer rate voltage Vdeg to the critical transfer rate voltage Vdeg×0.1. The relationship between the average image area ratio and the target value of the transfer current such that the output voltage value is in a range of the critical transfer rate voltage Vdeg or the critical transfer rate voltage Vdeg to the critical transfer rate voltage Vdeg×0.1 is stored in a data storage unit, such as an IC, as an algorithm, such as a relationship expression or a lookup data table. The target value corresponding to the average image area ratio on the photosensitive element 2Y is selected based on this algorithm, and constant current control is performed such that the output current is changed so as to coincide with the target value. Thus, it is possible to allow a necessary amount of primary transfer current to flow in the image portion of the photosensitive element 2Y, obtaining a satisfactory primary transfer rate, regardless of the average image area ratio.

In the embodiment, the value of the critical transfer rate voltage Vdeg [V] is 2000 [V], thus an algorithm is used in which the target value of the output current is selected in accordance with the average image area ratio such that the primary transfer voltage is in a range of 1800 to 2000 [V]. When the average image area ratio is 100[%], 15 [μA] flows at 1800 [V] and 21 [μA] flows at 2000 [V]. Thus, the target value of 15 to 21 [μA] is selected. When the average image area ratio is 5[%], 24 [μA] flows at 1800 [V] and 30 [μA] flows at 2000 [V]. Thus, the target value of 24 to 30 [μA] is selected. For another average image area ratio, similarly, the target value is selected such that the output voltage can be in a range of 1800 [V] to 2000 [V].

On the other hand, the M, C, and Bk primary transfer power supplies 81M, 81C, and 81Bk are configured to perform constant current control as follows. That is, the control method of the primary transfer bias differs between a state A, a state B, and a state C.

The state A refers to the state where, of a plurality of "ten-line sections" of the photosensitive element (2M, 2C, or 2Bk), the average image area ratio of the "ten-line section" which is moved into the exit of the primary transfer nip is zero. In the state A, it is not necessary that the toner image on the photosensitive element is primarily transferred to the belt. For this reason, for the suppression of reverse transfer of toner on the belt preferentially over the primary transfer efficiency of the toner image on the photosensitive element, a predetermined lower limit value is selected as the target value of the output current. The lower limit value is experimentally obtained in advance. Insofar as the target value is set to the lower limit value, it is possible to substantially avoid reverse transfer of toner on the belt, regardless of the image area ratio of the "ten-line section" of the photosensitive element or the image area ratio of a "belt area corresponding to ten lines" which is the intermediate transfer belt area corresponding to the "ten-line section." In the embodiment, 11 [μA] is used as the lower limit value.

The state B refers to the stat where the average image area ratio of the "ten-line section" of the photosensitive element which is moved into the exit of the primary transfer nip is greater than zero and the average image area ratio of the "belt area corresponding to ten lines" which is moved into the exit of the primary transfer nip is zero. In the state B, around the exit inside the primary transfer nip, toner which will be reversely transferred to the photosensitive element does not exist on the belt. For this reason, for the primary transfer efficiency of the toner image on the photosensitive element preferentially over the suppression of reverse transfer of toner on the belt, the following is used as an algorithm for selecting the target value of the transfer current. That is, an algorithm is used to the target value of the transfer current such that, when the average image area ratio of the "belt area corresponding to ten lines" is zero (is not actually zero), the output voltage is in a range of the critical transfer rate voltage Vdeg or the critical transfer rate voltage Vdeg to the critical transfer rate voltage Vdeg×0.1. That is, the algorithm is the same as the algorithm for Y. This algorithm is selected, such that the toner image on the photosensitive element can be primarily transferred to the belt efficiently without reverse transfer.

The state C refers to the state where the average image area ratio of the "ten-line section" of the photosensitive element which is moved into the exit of the primary transfer nip and the average image area ratio of the "belt area corresponding to ten lines" which is moved into the exit of the primary transfer nip are both greater than zero. In the state C, around the exit inside the primary transfer nip, there is a possibility that toner which will be reversely transferred to the photosensitive element exists on the belt. For this reason, for the suppression of reverse transfer of toner on the belt preferentially over the primary transfer efficiency of the toner image on the photosensitive element, the following is selected as an algorithm for selecting the target value of the transfer current. That is, when the average image area ratio of the "belt area corresponding to ten lines" is zero (is not actually zero), an algorithm is used to obtain the target value of the transfer current such that the output voltage is in a predetermined range around the reverse transfer avoidance upper limit voltage Vrev. In the embodiment, the range of Vrev−Vrev×0.1 to Vrev+Vrev×0.1 is used as the predetermined range. This algorithm is selected, such that the toner image on the photosensitive element can be primarily transferred to the belt efficiently while effectively suppressing reverse transfer.

In the embodiment, the reverse transfer avoidance upper limit voltage Vrev is 1600 [V]. For this reason, an algorithm is used in which the target value is selected in accordance with the average image area ratio such that the output voltage is in a range of 1440 to 1760 [V]. When the average image area ratio is 100[%], 7 [μA] flows at 1440 [V] and 16 [μA] flows at 1760 [V]. Thus, the target value of 7 to 16 [μA] is selected. When the average image area ratio is 5[%], 15 [μA] flows at 1440 [V] and 23 [μA] flows at 1760 [V]. Thus, the target value of 15 to 23 [μA] is selected. With regard to another average image area ratio, similarly, the target value is selected such that the output voltage is in a range of 1440 [V] to 1760 [V].

In the state C, the average image area ratio of the "belt area corresponding to ten lines" is not actually zero, the primary transfer current which actually flows may be out of the above-described range.

In selecting the target value of the output current such that the primary transfer voltage is in a predetermined range from the critical transfer rate voltage Vdeg or in selecting the target value of the output current such that the primary transfer voltage is in a predetermined range from the reverse transfer avoidance upper limit voltage Vrev, it is not necessary to unify the range with all the average image area ratios. The range may be changed in accordance with the average image area ratio. For example, in the configuration in which there is irregularity in the pressure distribution when the primary transfer roller presses the photosensitive element, and image density irregularity due to lacking in the transfer electric field easily occurs with a high image area ratio, in the case of a high image area ratio, it is effective to set the target value slightly high so as to reduce image density irregularity. In this case, when the average image area ratio is 100[%], the range of Vrev to Vrev×1.1 is set and, when the average image area ratio is 5[%], the range of Vrev to Vrev×1.0 is set. In this way, when the average image area ratio is comparatively high, the range is preferably further widened.

Hereinafter for convenience, as in the embodiment, the method which changes the target value of constant current control in accordance with the image area ratio is called a Dynamic Transfer Current Control (DTCC) method. In the related art, as the control method of the primary transfer bias, in addition to the general constant current method, the general constant voltage method, and the like, an Active Transfer Voltage Control (ATVC) method or a Programmable Transfer Voltage Control (PTVC) method is known. An image forming apparatus using the ATVC method is described in Japanese Patent Application Laid-open No. 2-123385. An image forming apparatus using the PTVC method is described in Japanese Patent Application Laid-open No. No. 5-181373.

The ATVC method or the PTVC method in the related art refers to constant voltage control in which the output current is controlled such that the output voltage is set to a predetermined target value. If the resistance (electrical resistance) of the primary transfer roller is changed due to the environmental variation, a desirable value of the output voltage is also changed, and the target value of the output voltage is changed in accordance with the measurement result of the resistance value of the primary transfer roller with a predetermined timing. This is different from the general constant voltage control. In measuring the resistance of the primary transfer roller, while a current is subjected to constant current control in the ATVC method, constant voltage control is performed in the PTVC method. In any method, in the related art, the same value is used as the target value of the output voltage for the first color and the second color and the latter colors. For this reason, toner on the belt is reversely transferred to the non-image portion of the photosensitive element in the primary transfer nip of the second color and the latter colors. The correction of the target value of the output voltage based on the measured value of the resistance value of the primary transfer roller is done with a predetermined timing. Meanwhile, when the resistance value is rapidly changed due to the rapid environmental variation, the corrected value is unreasonable. If the time interval of the resistance detection timing is shortened so as to suppress the occurrence of such a problem, the downtime of the device increases. In contrast, in the embodiment, control is performed such that the current value is made constant, a predetermined current flows to stabilize the transfer property, regardless of the change in resistance of the primary transfer roller.

Although an example has been described where the target value of the primary transfer current is changed in accordance with the average image area ratio of the "ten-line section," the method which calculates the average value of the image area ratios is not limited thereto. For example, the image area ratio may be calculated in terms of a number of pixels, such as a single pixel or 100 pixels. A method may be used in which the target value is not rapidly changed at the turn of the section but is changed gradually.

Next, Examples will be described where a more characteristic configuration is added to the printer of the embodiment.

FIRST EXAMPLE

In general, the value of the reverse transfer avoidance upper limit voltage Vrev varies significantly depending on the uniformly charged potential (hereinafter, referred to as a background portion potential) of the photosensitive element in addition to the image area ratio on the photosensitive element. However, if the process linear speed is constant, the reverse transfer avoidance upper limit current Irev,100 corresponding to the reverse transfer avoidance upper limit voltage Vrev for the entire solid image with an image area ratio 100[%] is substantially constant without being influenced by the background portion potential. In a printer according to a first example, first, as shown in FIG. 5, the reverse transfer avoidance upper limit current Irev,100 substantially becomes 11 [μA], regardless of the background portion potential of the photosensitive element. Thus, in the above-described state C, the target value corresponding to the average image area ratio 100[%] can be experimentally specified in advance.

On the other hand, in the case of an image with an average image area ratio smaller than 100[%], the reverse transfer avoidance upper limit current Irev,η (average image area ratio η<100) significantly differs depending on the background portion potential of the photosensitive element. As the background portion potential of the photosensitive element increases toward the negative side, the reverse transfer avoidance upper limit current Irev,η increases. For this reason, the reverse transfer avoidance upper limit current Irev,η cannot be made constant even when the average image area ratio η (η<100) is constant.

Thus, in the printer of the first example, a surface potential sensor is provided in each of the Y, M, C, and Bk process units 1Y, 1M, 1C, and 1Bk to detect the background portion potential after the photosensitive element has been uniformly charged. With regard to the three colors of M, C, and Bk, each of the primary transfer power supplies 81M, 81C, and 81Bk is configured to perform processing for correcting the target output current value Itr,η corresponding to the reverse transfer avoidance upper limit current Irev,η based on the detection result of the surface potential sensor.

The correction is done as follows. That is, in the printer of the first example, when the detection result of the background portion potential of the photosensitive element is −500 [V], the reverse transfer avoidance upper limit voltage Vrev is 1600 [V]. It is assumed that a monochrome solid image with an average image area ratio 100[%] which has been transferred to the belt in the previous primary transfer nip is moved into the primary transfer nip of the second color and the latter colors in which the background portion potential of the photosensitive element is −500 [V]. At this time, it is experimentally ascertained in advance that the reverse transfer avoidance upper limit current Irev,100 which is the output current value when the output value of the primary transfer voltage is set to 1600 [V] the same as the reverse transfer avoidance upper limit voltage Vrev is 11 [μA]. It is also assumed that a monochrome image with an average image area ratio 5[%] which has been transferred to the belt in the previous primary transfer nip is moved into the primary transfer nip of the second color and the latter colors in which the background portion potential of the photosensitive element −500 [V]. At this time, it is experimentally ascertained in advance that the reverse transfer avoidance upper limit current Irev,5 which is the output current value when the output value of the primary transfer voltage is set to 1600 [V] the same as the reverse transfer avoidance upper limit voltage Vrev is 18 [μA]. Thus, in the primary transfer nip of the second color and the latter colors, when the background portion potential of the photosensitive element is −500 [V], each of the primary transfer power supplies 81M, 81C, and 81Bk is configured to perform processing for calculating the target output current value Itr,η corresponding to the primary transfer nip based on the expression of Equation 1.

$$\text{Target Current Value } Itr,\eta[\mu A] = -0.0737\eta + 18.4 \quad (1)$$

Where η is an average image area ratio, and the uniformly charged potential of the photosensitive element is −500 [V]

In the primary transfer nip of the second color and the latter colors, when the detection result of the background portion potential of the photosensitive element by the surface potential sensor is not −500 [V], each of the primary transfer power supplies 81M, 81C, and 81Bk is configured to perform processing for calculating the target output current value Itr,η corresponding to the primary transfer nip as follows. That is, a computational expression for correction which has been experimentally constructed in advance is stored in the data storage unit, such as an IC. The computational expression for correction is constructed based on the experimental result of the relationship between the reverse transfer avoidance upper limit current Irev,η when the photosensitive element is uniformly charged with −500 V and the reverse transfer avoidance upper limit current Irev,η when the photosensitive element is uniformly charged with a value different from −500 V. If the calculation result of the target output current value Itr,η based on the expression of Equation 1 and the detection result of the background portion potential of the photosensitive element by the surface potential sensor are substituted into the computational expression for correction, the target output current value Itr,η corresponding to the background portion potential=−500 V can be corrected to the target output current value Itr,η corresponding to the actual background portion potential. The primary transfer power supplies 81M, 81C, and 81Bk are configured to perform constant current control with the target output current value Itr,η corrected in the above-described manner. In this configuration, even when the background portion potential of the photosensitive element varies due to the environmental variation or the like, the primary transfer voltage can be in a range of ±10% from the reverse transfer avoidance upper limit voltage Vrev, regardless of the image area ratio of the photosensitive element.

On the other hand, in general, the value of the critical transfer rate voltage Vdeg is also influenced by the background portion potential of the photosensitive element not a little. However, if the process linear speed is constant, the critical transfer rate current Ideg,100 corresponding to the critical transfer rate voltage Vdeg for the entire solid image on the photosensitive element with an image area ratio 100[%] is substantially made constant without being influenced by the background portion potential of the photosensitive element. In the printer of the first example, first, as shown in FIG. 5, the critical transfer rate current Ideg,100 is substantially 21 [μA], regardless of the background portion potential. Thus, in the Y primary transfer nip or the primary transfer nip of the second color and the latter colors, in the above-described state C, the target current value Itr,100 (Vdeg−Vdeg×0.1 to Vdeg) corresponding to an average image area ratio 100[%] can be experimentally specified in advance.

On the other hand, in the case of an image with an average image area ratio smaller than 100[%], the critical transfer rate current Ideg,η (average image area ratio η<100) varies depending on the background portion potential. For this reason, the critical transfer rate current Ideg,η cannot be made constant even when the average image area ratio η (η<100) is constant.

In the printer of the first example, the Y primary transfer power supply 81Y is configured to perform processing for correcting the target current value Itr,η corresponding to the critical transfer rate current Ideg,η (average image area ratio η<100) based on the detection result by the surface potential sensor. In the above-described state C, each of the M, C, and Bk primary transfer power supplies 81M, 81C, and 81Bk is configured to perform processing for correcting the target current value Itr,η corresponding to the critical transfer rate current Ideg,η (average image area ratio η<100).

The correction is performed as follows. That is, in the printer of the first example, when the uniformly charged potential of the photosensitive element is −500 [V], the critical transfer rate voltage Vdeg is 2000 [V]. It is assumed that a monochrome solid image with an average image area ratio 100[%] on the photosensitive element is moved into the primary transfer nip in which the uniformly charged potential of the photosensitive element is −500 [V]. At this time, it is experimentally ascertained in advance that the critical transfer rate current Ideg,100 which is the output current value when the output value of the primary transfer voltage is 2000 [V] the same as the critical transfer rate voltage Vdeg is 21 [μA]. It is also assumed that a monochrome solid image with an average image area ratio 5[%] on the photosensitive element is moved into the primary transfer nip of the second color and the latter colors in which the uniformly charged potential of the photosensitive element is −500 [V]. At this time, it is experimentally ascertained in advance that the critical transfer rate current Ideg,5 which is the output current value when the output value of the primary transfer voltage is 2000 [V] the same as the critical transfer rate voltage Vdeg is 30 [μA]. Based on this relationship, a formula is stored which is used to calculate the target output current value Itr corresponding to the primary transfer nip when the uniformly charged potential of the photosensitive element is −500 [V].

When the detection result of the uniformly charged potential (hereinafter, referred to as a background portion potential) of the photosensitive element by the surface potential sensor is not −500 [V], an expression for correction is stored which is used to correct the target output current value Itr,η calculated by the above-described formula. With this configuration, even when the background portion potential of the photosensitive element varies depending on the environmental variation or the like, in the Y primary transfer nip or in the above-described state B, the primary transfer voltage can be in a range of −10% from the critical transfer rate voltage Vdeg, regardless of the image area ratio of the photosensitive element.

SECOND EXAMPLE

Figure 10:
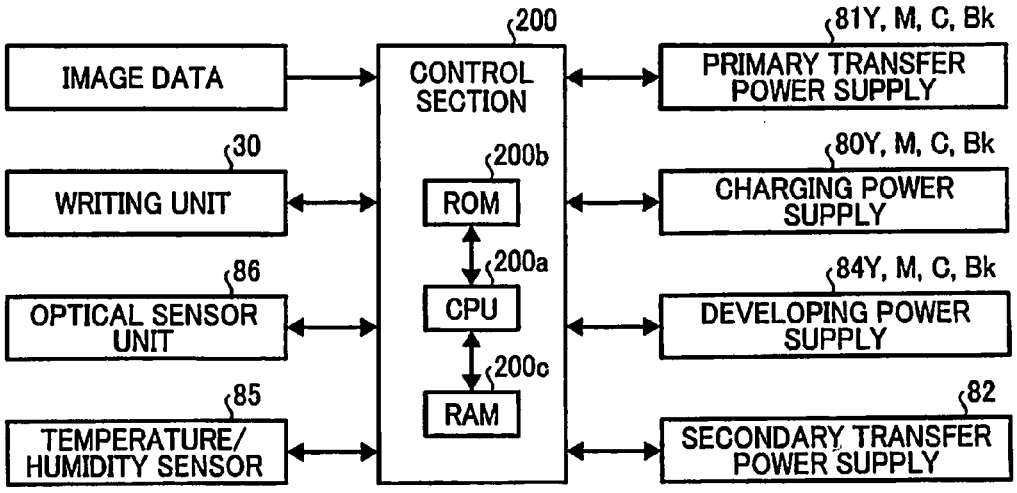
FIG. 10 is a block diagram showing a portion of an electrical circuit in a printer according to a second example.

FIG. 10 is a block diagram showing a portion of an electric circuit in a printer according to a second example. In FIG. 10, a control section 200 serving as a control unit 200 has a CPU 200*a* (Central Processing Unit) serving as an arithmetic unit, a RAM 200*c* (Random Access Memory) serving as a non-volatile memory, a ROM 200*b* (Read Only Memory) serving as a temporary storage unit, and the like. The control section 200 performs overall control of the apparatus. The control section 200 controls driving of the respective units based on a control program stored in the RAM 200*c* or the ROM 200*b*. The control section 200 also calculates an average image area ratio for each of a plurality of "ten-line sections" of the photosensitive element of each color based on image data (write signal at the time of exposure) transmitted from an external personal computer or the like. The calculation results of the average image area ratio are transmitted to the primary transfer power supplies 81Y, 81M, 81C, and 81Bk.

Figure 11:
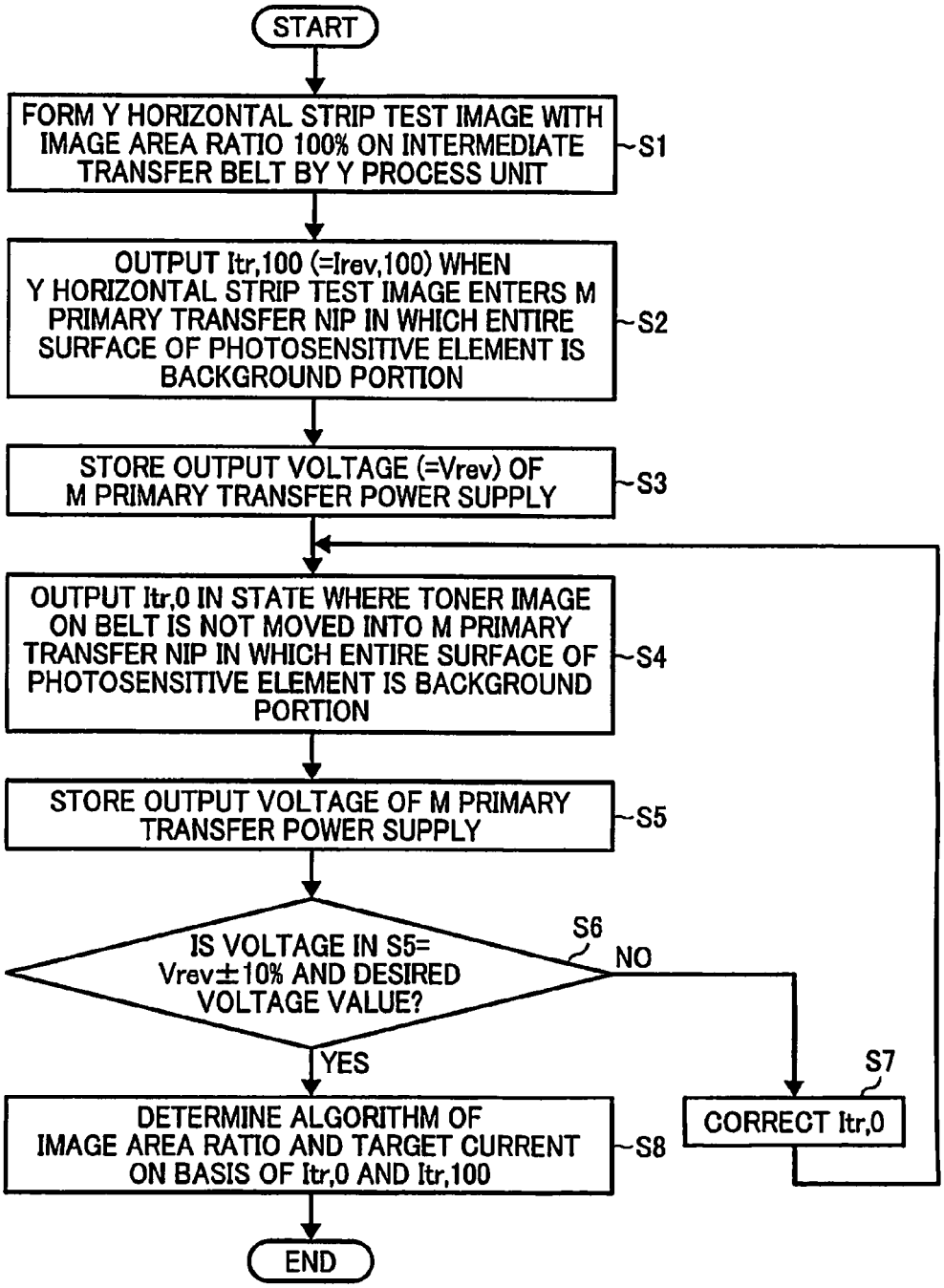
FIG. 11 is a flowchart showing a control flow of algorithm update processing which is performed by a control section of the printer.

FIG. 11 is a flowchart showing a control flow of algorithm update processing which is performed by the control section 200. The algorithm update processing is performed each time a predetermined timing is reached, for example, each time a predetermined time has elapsed. First, a Y horizontal strip test image with an image area ratio 100[%] is formed on the surface of the photosensitive element 2Y by the Y process unit 1Y and transferred to the surface of the intermediate transfer belt 21 in the Y primary transfer nip (Step 1: hereinafter, Step is abbreviated as S). Next, if the Y horizontal strip test image is moved into the M primary transfer nip with endless movement of the intermediate transfer belt 21, the M primary transfer power supply 81M performs constant current control under the condition that the target current value Itr,100 is the same as the reverse transfer avoidance upper limit current Irev,100 (S2). The output voltage value from the primary transfer power supply 81M at this time is stored as the reverse transfer avoidance upper limit voltage Vrev in a storage unit (S3). Next, in a state where the toner image on the intermediate transfer belt 21 is not moved into the M primary transfer nip in which the entire surface of the photosensitive element 2M is the background portion, the primary transfer power supply 81M performs constant current control under the condition of a predetermined target current value Itr,0 (S4). The output voltage from the primary transfer power supply 81M at this time is stored in the data storage unit (S5). Thereafter, it is determined whether or not the voltage stored in S5 is in a range of ±10% from the reverse transfer avoidance upper limit voltage Vrev and is close to a desired value (S6). When the determination result is No, the target current value Itr,0 is corrected (S7), and then the control flow returns to S4. Meanwhile, when the determination result is Yes, a new algorithm which represents the relationship between the average image area ratio and the target current value Itr,η is constructed based on the target current value Itr,0 and the target current value Itr,100 (S8).

Although the algorithm update processing (for the state C) for calculating the M target current value Itr,η has been described, a new algorithm for the state C is updated in the same manner for the C or Bk target current value Itr,η.

With this configuration, even when the algorithm representing the relationship between the target current value Itr,η and the average image area ratio stored in the data storage unit is unreasonable due to the variation in the background portion potential of the photosensitive element, or the like, a reasonable algorithm can be newly constructed.

THIRD EXAMPLE

Figure 12:
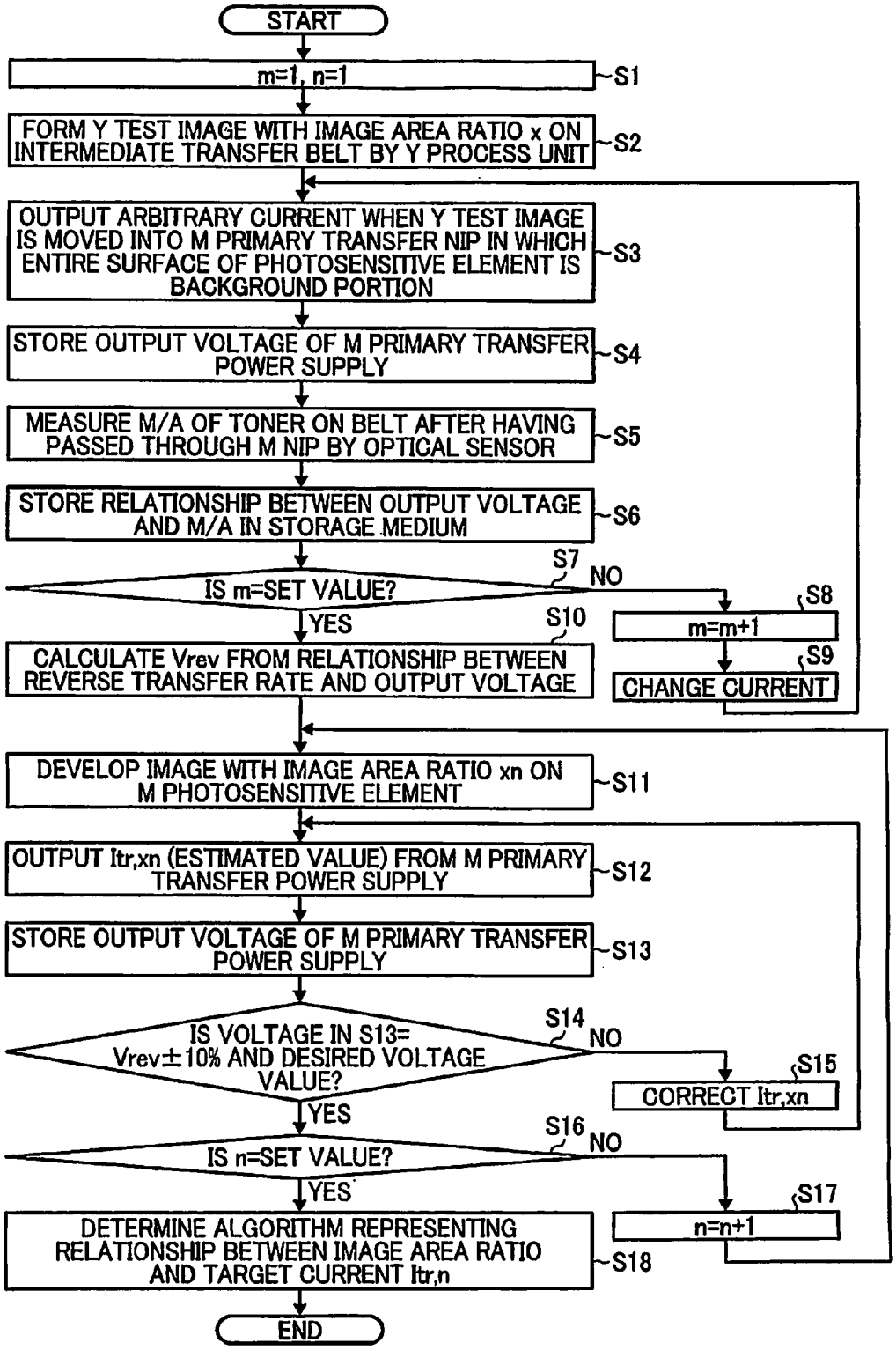
FIG. 12 is a flowchart showing a control flow of algorithm update processing which is performed by a control section of a printer according to a third example.

FIG. 12 is a flowchart showing a control flow of algorithm update processing which is performed by a control section of a printer according to a third example. The algorithm update processing is performed each time a predetermined timing is reached, for example, each time a predetermined time has lapsed. First, a variable m and a variable n are set to an initial value "1" (S1). A Y test image with an image area ratio x is formed on the Y photosensitive element 2Y by the Y process unit 1Y and then transferred to the intermediate transfer belt 21 in the Y primary transfer nip (S2). Next, if the Y test image on the belt is moved into the M primary transfer nip in which the entire surface of the M photosensitive element 2M is the background portion, the M primary transfer power supply 81M outputs an arbitrary primary transfer current (S3). The output voltage from the primary transfer power supply 81M at this time is stored in the data storage unit (S4). Next, the stuck toner amount (M/A) per unit area for the Y test image on the intermediate transfer belt immediately after having passed through the M primary transfer nip is detected by an optical sensor (S5). The detection result is stored in the data storage unit in association with the output voltage of S4 (S6). Thereafter, it is determined whether or not the variable m reaches a predetermined set value (S7), and when the variable m does not reach the predetermined set value, the variable m is incremented by "1." Then, the condition of the current value in S3 is changed, and the flow from S3 is again performed (No in S7, S8, and S9). Meanwhile, when the variable m reaches the predetermined set value (Yes in S7), the reverse transfer avoidance upper limit voltage Vrev is calculated based on the relationship between the change amount of the stuck toner amount and various voltages stored in the data stored unit, (S10).

In the third example, in this way, the reverse transfer avoidance upper limit voltage Vrev immediately before the reverse transfer rate rapidly increases is measured based on the change amount of the stuck toner amount. Thereafter, after an M image with an image area ratio xn is developed by the M photosensitive element 2M (S11), in a state where the M image is moved into the M primary transfer nip, the target current value Itr,xn is output from the M primary transfer power supply 81M (S12). The output voltage from the primary transfer power supply 81M at this time is stored in the data storage unit (S13), and it is then determined whether or not the value is in a range of ±10[%] with respect to the reverse transfer avoidance upper limit voltage Vrev calculated in S10 and close to a desired value (S14). When the determination result is No, the target current value Itr,xn is corrected (S15), and then the flow from S11 is again performed. Meanwhile, when the determination result is Yes, it is determined whether or not the variable n reaches a predetermined set value, and when the variable n does not reach the predetermined set value, the variable n is incremented by "1," and then the flow from S11 is again performed (No in S16, S17). Meanwhile, when the variable n reaches the predetermined set value, an algorithm (for the state C) representing the relationship between the image area ratio and the target current value Itr,η is newly constructed based on the relationship between the image area ratio and the target current value Itr,xn (S18).

Although the algorithm update processing (for the state C) for calculating the M target current value Itr,η has been described, a new algorithm for the above-described state C is updated in the same manner for the C or Bk target current value Itr,η.

With this configuration, even when the algorithm representing the relationship between the target-current value Itr,η and the average image area ratio stored in the data storage unit is unreasonable due to the variation in the background portion potential of the photosensitive element, or the like, a reasonable algorithm can be newly constructed.

FOURTH EXAMPLE

Figure 13:
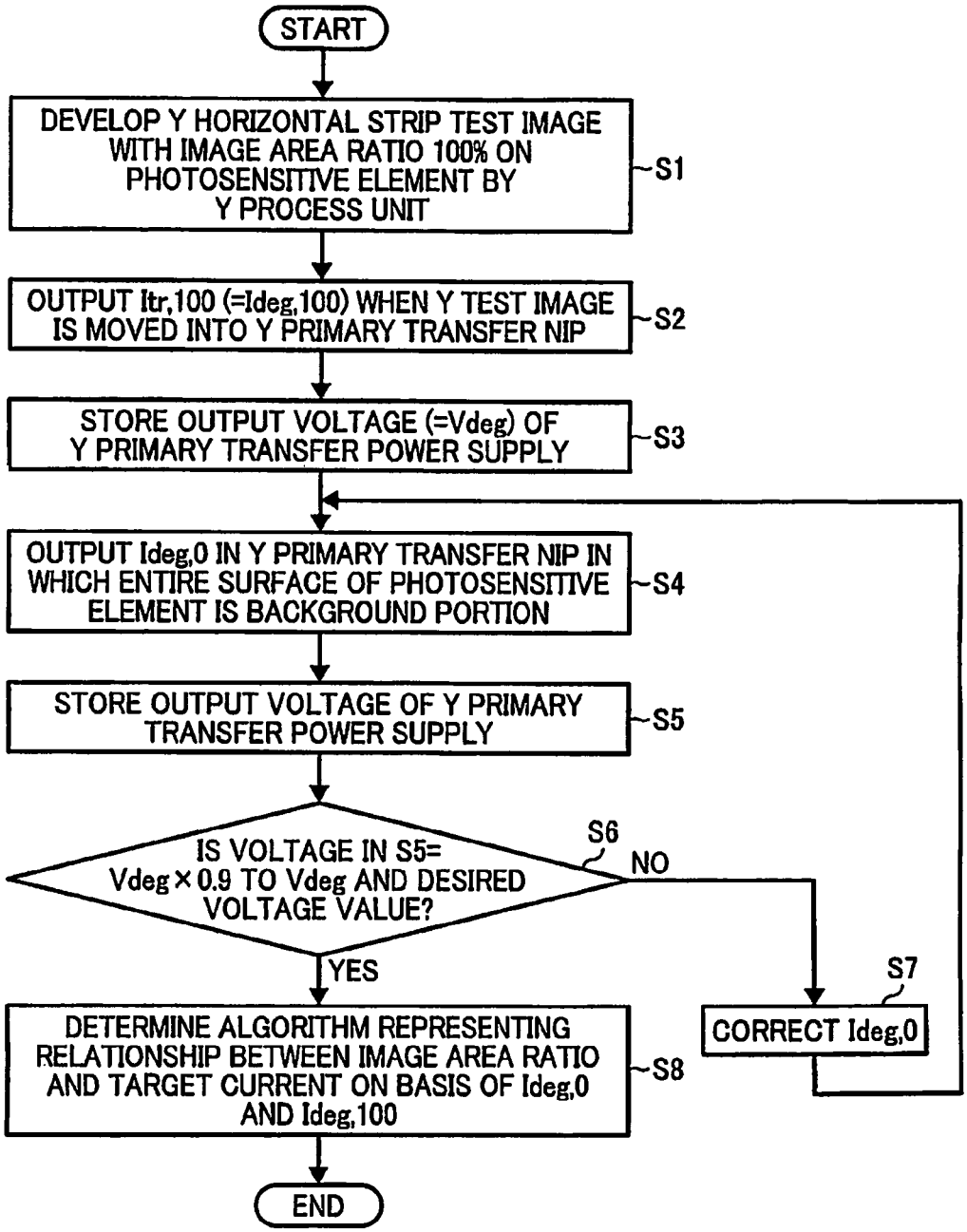
FIG. 13 is a flowchart showing a control flow of algorithm update processing which is performed by a control section of a printer according to a fourth example.

FIG. 13 is a flowchart showing a control flow of algorithm update processing which is performed by a control section 200 of a printer according to a fourth example. The algorithm update processing is performed each time a predetermined timing is reached, for example, each time a predetermined time has elapsed. First, a Y horizontal strip test image with an image area ratio 100[%] is developed on the surface of the photosensitive element 2Y by the Y process unit 1Y (S1). If the Y test image is moved into the Y primary transfer nip with rotation of the photosensitive element, constant current control is performed such that the target current value Itr,100 is set to the same value as the critical transfer rate current Ideg,100 from the Y primary transfer power supply 81Y (S2). The output voltage from the primary transfer power supply 81Y at this time is stored as the critical transfer rate voltage Vdeg in the data storage unit (S3). Next, the critical transfer rate current Ideg,0 is output from the primary transfer power supply 81Y in a state where the entire surface of the photosensitive element 2Y is the background portion (S4). The output voltage from the primary transfer power supply 81Y at this time is stored in the data storage unit (S5), and it is then determined whether or not the value is in a range of the critical transfer rate voltage Vdeg to the critical transfer rate voltage Vdeg×0.9 and is close to a desired value (S6). When the determination result is No, the critical transfer rate current Ideg,0 is corrected (S7) and then the flow from S4 is again performed. Meanwhile, when the determination result is Yes, the algorithm (for the Y color) representing the relationship between the image area ratio and the target current value Itr,η is newly constructed based on the critical transfer rate current Ideg,0 and the critical transfer rate current Ideg,100 (S8).

Although the algorithm update processing for calculating the Y target current value Itr,η has been described, the algorithm for the above-described state B is newly updated for M, C, and Bk in the same manner as Y.

With this configuration, even when the algorithm (for Y and the state B of M, C, and Bk) representing the relationship between the target current value Itr,η and the average image area ratio stored in the data storage unit is unreasonable due to the variation in the background portion potential of the photosensitive element, or the like, a reasonable algorithm can be newly constructed.

FIFTH EXAMPLE

Figure 14:
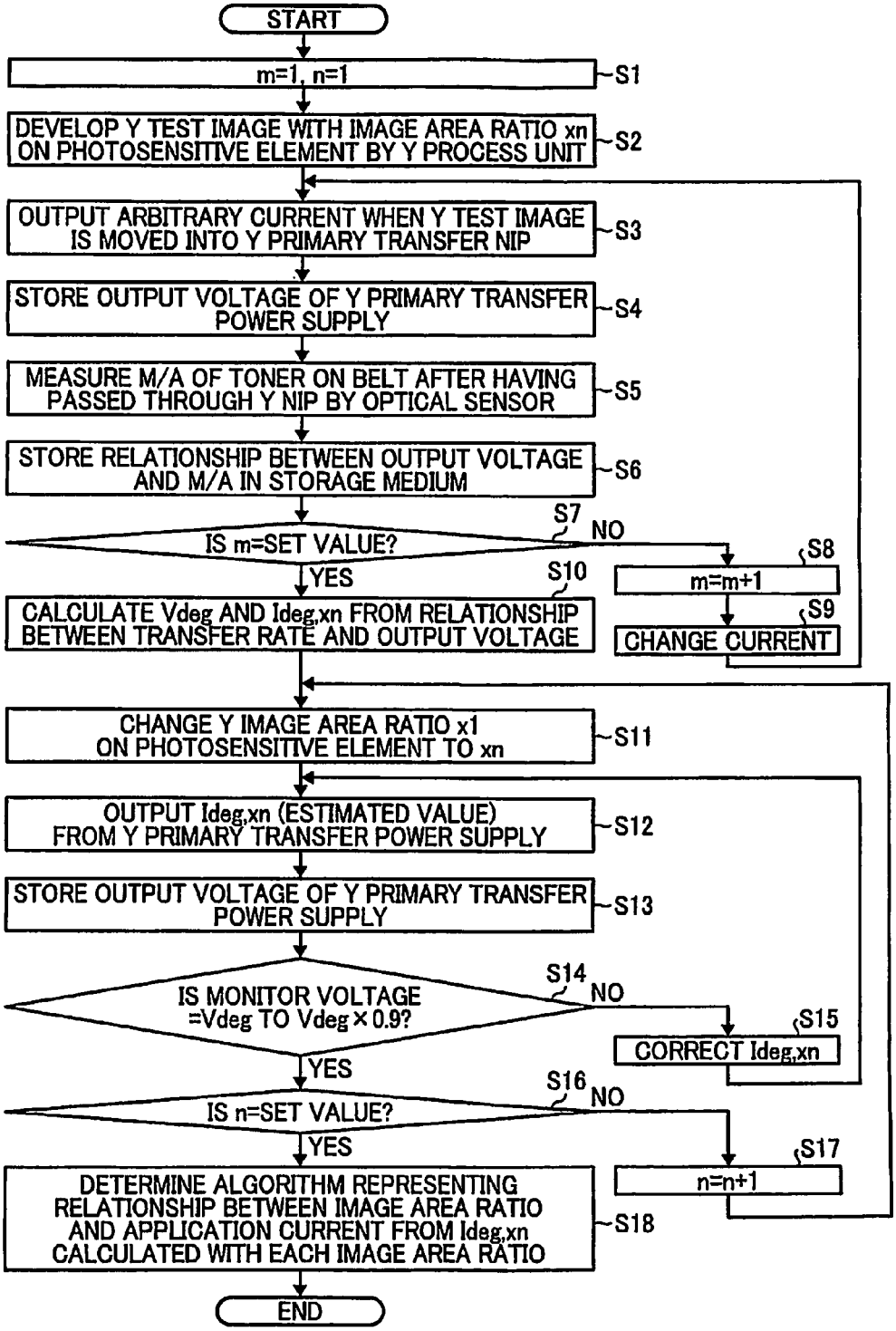
FIG. 14 is a flowchart showing a control flow of algorithm update processing which is performed by a control section of a printer according to a fifth example.

FIG. 14 is a flowchart showing a control flow of algorithm update processing which is performed by a control section of a printer according to a fifth example. The algorithm update processing is performed each time a predetermined timing is reached, for example, each time a predetermined time has elapsed. First, the variable m and the variable n are set to the initial value "1" (S1). Next, a Y test image with an image area ratio xn is developed on the Y photosensitive element 2Y by the Y process unit 1Y (S2). When the Y test image is moved into the Y primary transfer nip, the Y primary transfer power supply 81Y outputs an arbitrary primary transfer current (S3). The output voltage from the primary transfer power supply 81Y at this time is stored in the data storage unit (S4). Next, the stuck toner amount (M/A) per unit area for the Y test image on the intermediate transfer belt immediately after having passed through the Y primary transfer nip is detected by an optical sensor (S5). The detection result is stored in the data storage unit in association with the output voltage in S4 (S6). Thereafter, it is determined whether or not the variable m reaches a predetermined set value (S7), and when the variable m does not reach the predetermined set value, the variable m is incremented by "1," the condition of the current value in S3 is changed, and subsequently the flow from S3 is again performed (No in S7, S8, S9). Meanwhile, when the variable m reaches the predetermined set value (Yes in S7), the critical transfer rate voltage Vdeg and the critical transfer rate current Ideg,xn are calculated based on the relationship between the change amount of the stuck toner amount and various voltages stored in the data storage unit (S10).

In the fifth example, in this way, the critical transfer rate voltage Vdeg immediately before the primary transfer rate rapidly decreases is measured based on the change amount of the stuck toner amount. Thereafter, a Y image with an image area ratio xn is developed by the Y photosensitive element 2Y (S11) and in a state where the Y image is moved into the Y primary transfer nip, the critical transfer rate current Ideg,xn (estimation value) is output from the Y primary transfer power supply 81Y (S12). The output voltage from the primary transfer power supply 81Y at this time is stored in the data storage unit (S13), and it is then determined whether or not the value is in a range of the critical transfer rate voltage Vdeg calculated in S10 to the critical transfer rate voltage Vdeg×0.9 and is closed to a desired value (S14). When the determination result is No, the critical transfer rate current Ideg,xn is corrected (S15) and then the flow from S12 is again performed. Meanwhile, when the determination result is Yes, it is determined whether or not the variable n reaches a predetermined set value (S16). When the variable n does not reach the predetermined set value, the variable n is incremented by "1" (S17) and then the flow from S11 is again performed. Meanwhile, when variable n reaches a predetermined set value, the algorithm (for the Y color) representing the image area ratio and the target current value Itr,η is newly constructed based on the relationship between the image area ratio and the critical transfer rate current Ideg,xn (S18).

Although the algorithm update processing for calculating the Y target current value Itr,η has been described, the algorithm for calculating the target current value Itr,η in the state B is newly constructed for M, C, and Bk in the same manner.

With this configuration, even when the algorithm (for Y and the state B of M, C, and Bk) representing the relationship between the target current value Itr,η and the average image area ratio stored in the data storage unit is unreasonable due to the variation in the background portion potential of the photosensitive element, or the like, a reasonable algorithm can be newly constructed.

SIXTH EXAMPLE

Figure 15:
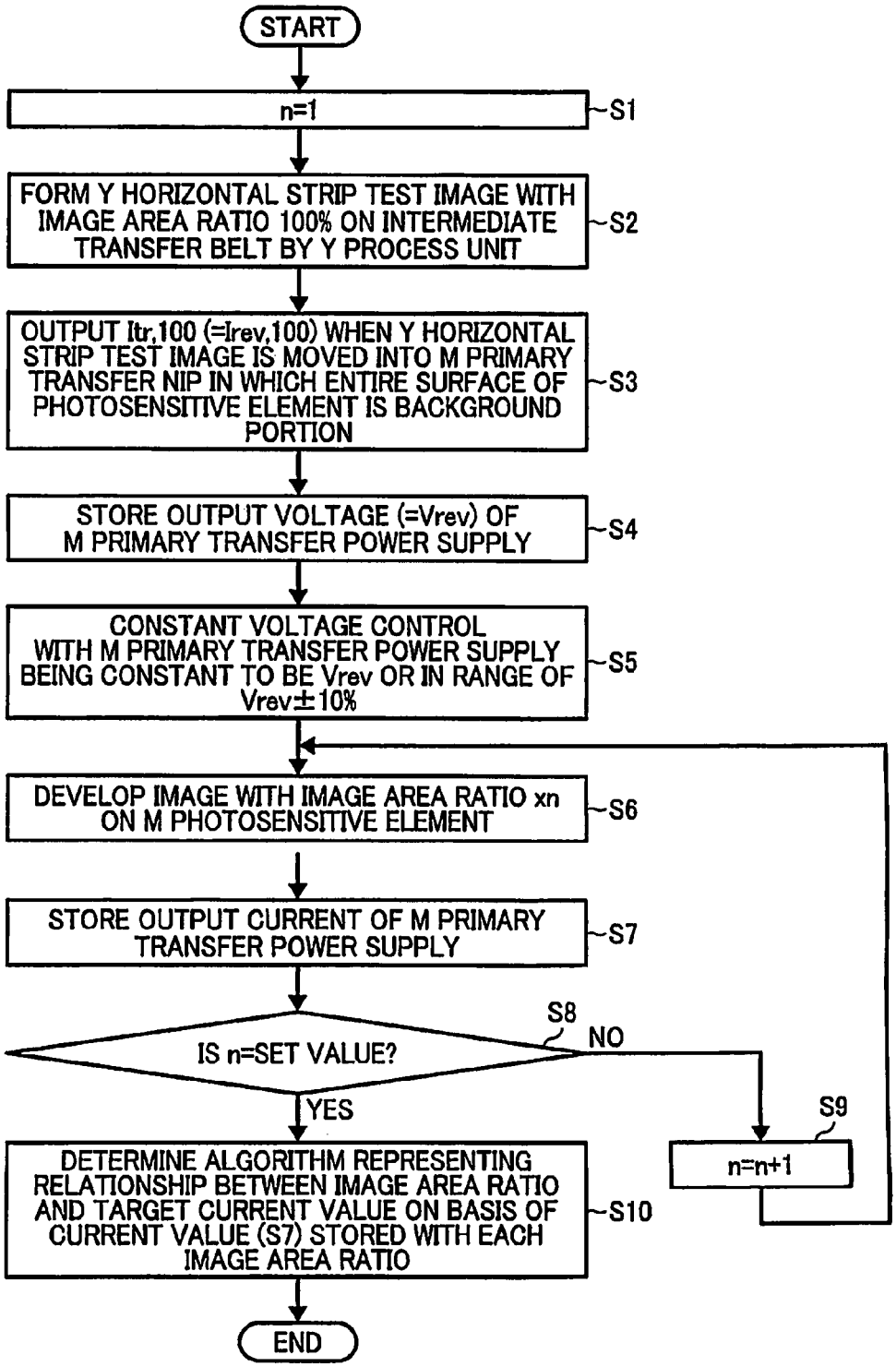
FIG. 15 is a flowchart showing a control flow of algorithm update processing which is performed by a control section of a printer according to a sixth example.

FIG. 15 is a flowchart showing a control flow of algorithm update processing which is performed by a control section 200 of a printer according to a sixth example. The algorithm update processing is performed each time a predetermined timing is reached, for example, each time a predetermined time has elapsed. First, the variable n is set to the initial value "1" (S1), and then a Y horizontal strip test image with an image area ratio 100[%] is developed on the surface of the photosensitive element 2Y by the Y process unit 1Y and transferred to the intermediate transfer belt 21 in the Y primary transfer nip (S2). Next, if the Y horizontal strip test image is moved into the M primary transfer nip in which the entire surface of the photosensitive element 2M is the background portion, the M primary transfer power supply 81M performs constant current control such that the target current value Itr,100 is set to the same value as the reverse transfer avoidance upper limit current Irev,100 (S3). The output voltage from the primary transfer power supply 81M at this time is stored as the reverse transfer avoidance upper limit voltage Vrev in the data storage unit (S4). Next, the M primary transfer power supply 81M performs constant voltage control for the output voltage with the reverse transfer avoidance upper limit voltage Vrev or a voltage in a range of ±10% from the reverse transfer avoidance upper limit voltage Vrev as the target value (S5). In this state, an M test image with an image area ratio xn is developed on the M photosensitive element 2M (S6), and the output current value from the primary transfer power supply 81M when the M test image is moved into the M primary transfer nip is stored in the data storage unit (S7). It is determined whether or not the variable n reaches a predetermined set value (S8). When the variable n does not reach the predetermined set value, the variable n is incremented by "1," (S9) and the flow from S6 is again performed. Meanwhile, when the variable n reaches the predetermined set value, the algorithm (for the above-described state C of M) representing the relationship between the image area ratio and the target current value is constructed based on the current value corresponding to each image area ratio stored in S7 (S10).

Although the algorithm update processing for calculating the target current value Itr,η for the above-described state C of M has been described, the algorithm for the above-described state C is newly updated for C and Bk in the same manner.

With this configuration, even when the algorithm (for the state C) representing the relationship between the target current value Itr,η and the average image area ratio stored in the data storage unit is unreasonable due to the variation in the background portion potential of the photosensitive element, or the like, a reasonable algorithm can be newly constructed.

SEVENTH EXAMPLE

Figure 16:
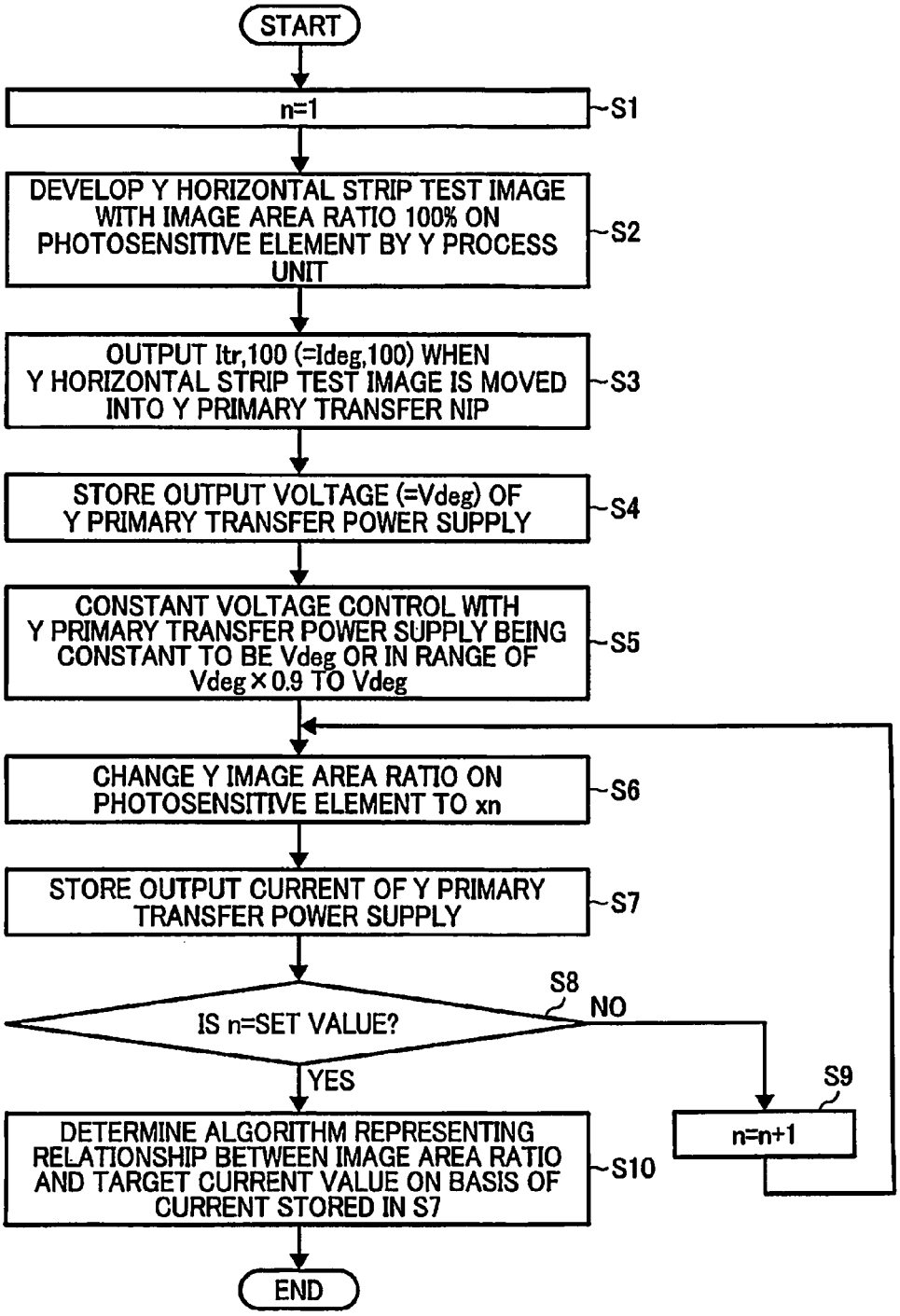
FIG. 16 is a flowchart showing a control flow of algorithm update processing which is performed by a control section of a printer according to a seventh example.

FIG. 16 is a flowchart showing a control flow of algorithm update processing which is performed by a control section of a printer according to a seventh example. The algorithm update processing is performed each time a predetermined timing is reached, for example, each time a predetermined time has elapsed. First, the variable n is set to the initial value "1" (S1). Next, a Y horizontal strip test image is developed on the Y photosensitive element 2Y by the Y process unit 1Y (S2). When the Y horizontal strip test image is moved into the Y primary transfer nip, the Y primary transfer power supply 81Y performs constant current control with the target current value Itr,100 the same as the critical transfer rate current Ideg,100 (S3). The output voltage from the primary transfer power supply 81Y at this time is stored as the critical transfer rate voltage Vdeg in the data storage unit (S4). Next, the Y primary transfer power supply 81Y performs constant voltage control with the critical transfer rate voltage Vdeg or a voltage in a range of Vdeg to Vdeg×0.9 as the target value (S5). In this state, a Y horizontal strip test image with an image area ratio xn is formed on the Y photosensitive element 2Y and moved into the Y primary transfer nip (S6). The output current value from the primary transfer power supply 81Y at this time is stored in the data storage unit (S7), and it is then determined whether or not the variable n reaches a predetermined set value (S8). When the variable n does not reach the predetermined set value, the variable n is incremented by "1" (S9) and then the flow from S6 is again performed. Meanwhile, when the variable n reaches the predetermined set value, the algorithm representing the relationship between the image area ratio and the target current value is newly constructed based on the relationship between the image area ratio and the current stored in S7 (S10).

Although the algorithm update processing for calculating the Y target current value Itr,η has been described, the algorithm for calculating the target current value Itr,η in the state B is newly updated for M, C, and Bk in the same manner.

With this configuration, even when the algorithm (for Y and the state B of M, C, and Bk) representing the relationship between the target current value Itr,η and the average image area ratio stored in the data storage unit is unreasonable due to the variation in the background portion potential of the photosensitive element, or the like, a reasonable algorithm can be newly constructed.

Next, modifications of the printer according to the embodiment will be described. Unless particularly described, the configuration of the printer according to each modification is the same as in the embodiment.

First Modification

Figure 17:
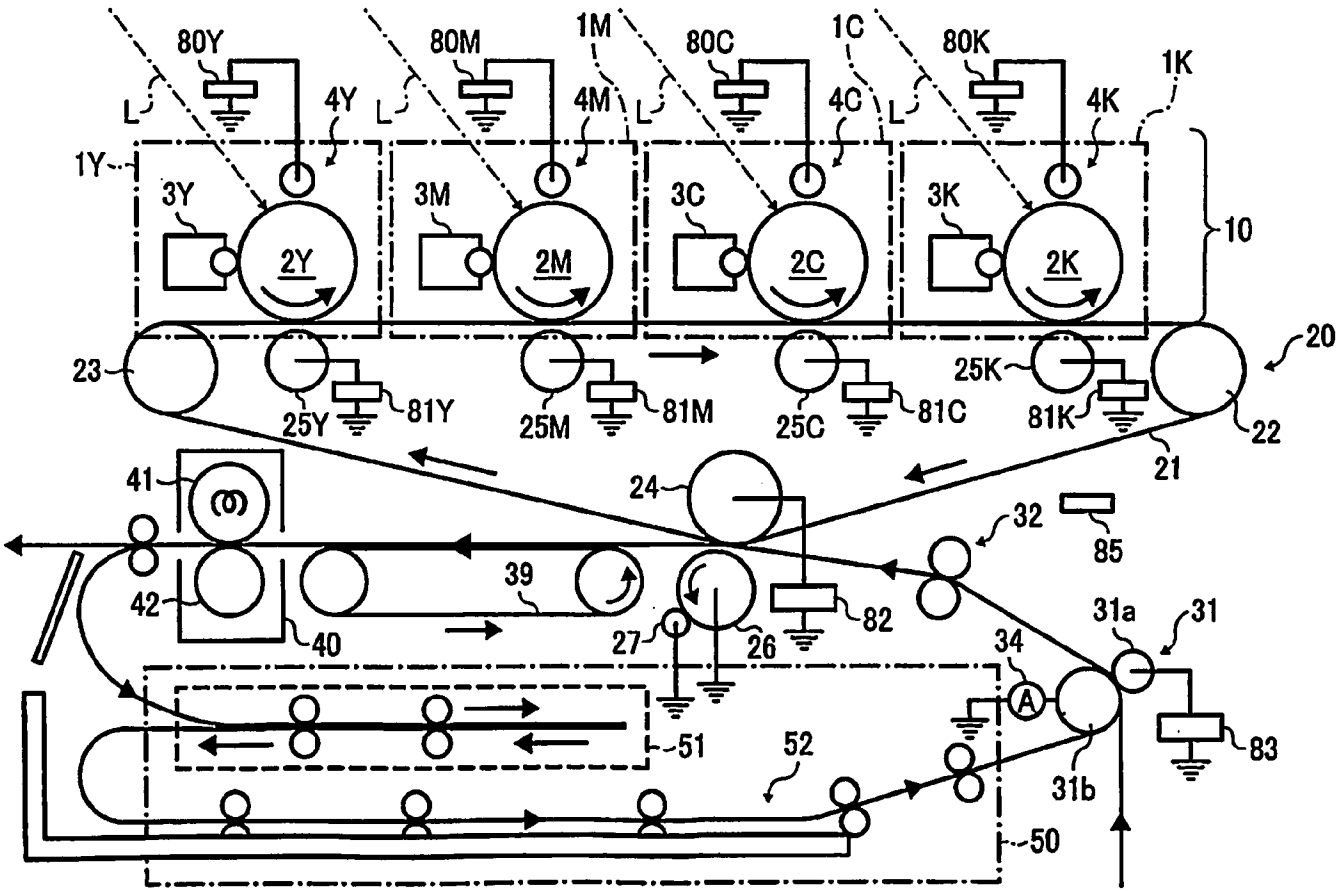
FIG. 17 is a schematic configuration diagram showing a printer according to a first modification.

FIG. 17 is a schematic configuration diagram showing a printer according to a first modification. The printer is different from the printer of the embodiment in which the recording sheet P is conveyed in the vertical direction in that an image is formed on the recording sheet P while the recording sheet P is conveyed in the horizontal direction inside the apparatus.

A tandem toner image forming section 10 has four image forming units 1Y, 1M, 1C, and 1Bk for forming the toner images of the respective colors of Y, M, C, and Bk. A transfer unit 20 has an endless intermediate transfer belt 21 serving as a nip forming member, a driving roller 22, a driven roller 23, a secondary transfer counter roller 24, four primary transfer rollers 25Y, 25M, 25C, and 25Bk, a secondary transfer roller 26, and the like.

The endless intermediate transfer belt 21 is stretched between the driving roller 22, the driven roller 23, and the secondary transfer counter roller 24 in an inverted triangular shape when viewed from the lateral side. The intermediate transfer belt 21 is a carbon-dispersed polyimide belt and has a thickness of 60 [μm], volume resistivity of about 1E9 [Ω·cm] (a measured value by Highlester UP MCP HT450 of Mitsubishi Chemical Corporation with an application voltage of 100 [V]), and tensional elasticity of 2.6 [GPa]. The driving roller 22 is driven to rotate by a driving device (not shown), such that the intermediate transfer belt 21 is moved in an endless manner in the clockwise direction of the drawing. Inside the loop of the intermediate transfer belt 21, in addition to the driving roller 22, the driven roller 23, and the secondary transfer counter roller 24, the four primary transfer rollers 25Y, 25M, 25C, and 25Bk are also provided.

The tandem toner image forming section 10 is provided above the transfer unit 20 in a state where the four image forming units 1Y, 1M, 1C, and 1Bk are arranged in the horizontal direction along the upper stretched surface of the intermediate transfer belt 21. The image forming units 1Y, 1M, 1C, and 1Bk serving as an image forming section respectively have drum-like photosensitive elements 2Y, 2M, 2C, and 2Bk which are driven to rotate in the counterclockwise direction of the drawing, developing units 3Y, 3M, 3C, and 3Bk, and charging units 4Y, 4M, 4C, and 4Bk. The photosensitive elements 2Y, 2M, 2C, and 2Bk serving as a latent image carrier respectively come into contact with the upper stretched surface of the intermediate transfer belt 21 to form the Y, M, C, and Bk primary transfer nips, and are driven to rotate in the counterclockwise direction by a driving unit (not shown).

The photosensitive elements 2Y, 2M, 2C, and 2Bk (ϕ60) are organic photosensitive elements and the electrostatic capacitance of the photosensitive layer thereof is about 9.5E-7 [F/m$^2$]. The charging units 4Y, 4M, 4C, and 4Bk are respectively applied with charging bias from charging power supplies 80Y, 80M, 80C, and 80Bk to uniformly charge the surfaces of the photosensitive elements 2Y, 2M, 2C, and 2Bk with the same polarity as the charged polarity of toner.

The developing units 3Y, 3M, 3C, and 3Bk serving as a developing unit accommodate pulverized toner made of a magnetic carrier and a polyester-based material, and respective have developing rollers 3*a*Y, 3*a*M, 3*a*C, and 3*a*Bk serving as a developer carrier. The developing rollers 3*a*Y, 3*a*M, 3*a*C, and 3*a*Bk are rotated in the clockwise direction of the drawing by a driving motor (not shown) to hold a necessary amount of developer on the surfaces thereof and to convey the developer to a position facing the photosensitive element. A plurality of magnets are provided inside each developing roller, and the developer held on the surface of the developing roller form a bristle by magnetic force facing the developing area in the developing area, and the magnetically raised bristle on the surface of the developing roller comes into contact with the photosensitive element. Developing bias is applied from a power supply (not shown) to the developing rollers 3*a*Y, 3*a*M, 3*a*C, and 3*a*Bk. Toner is moved from the bristle of the developer on the developing rollers 3*a*Y, 3*a*M, 3*a*C, and 3*a*Bk onto the surfaces of the photosensitive elements by a latent image electric field formed by the developing bias and the electrostatic latent images of the photosensitive element to develop electrostatic latent images.

Below the Y, M, C, and Bk primary transfer nips, inside the loop of the intermediate transfer belt 21, the primary transfer rollers 25Y, 25M, 25C, and 25Bk press the intermediate transfer belt 21 against the photosensitive elements 2Y, 2M, 2C, and 2Bk. The four primary transfer rollers 25Y, 25M, 25C, and 25Bk are rollers in which a metallic core is coated with an elastic member, such as sponge, and the volume resistance value excluding the core is 1E9 [Ω·cm]. The primary transfer rollers 25Y, 25M, 25C, and 25Bk are applied with the primary transfer current having a polarity opposite to the charged polarity of toner subjected to constant current control by the primary transfer power supplies 81Y, 81M, 81C, and 81Bk.

Above the tandem toner image forming section 10, an optical writing unit (not shown) serving as a latent image forming unit is provided. The optical writing unit performs optical writing processing by scanning line L for the surfaces of the photosensitive elements 2Y, 2M, 2C, and 2Bk, which are uniformly charged with −650 [V] by the charging units 4Y, 4M, 4C, and 4Bk, to form electrostatic latent images. In the case of a solid image, the potential V1 of an electrostatic latent image is about −100 [V]. The electrostatic latent images formed on the photosensitive elements 2Y, 2M, 2C, and 2Bk are inversely developed with toner having a negative polarity (the charging amount of about −20 [μc/g]) by the developing units 3Y, 3M, 3C, and 3Bk and become Y, M, C, and Bk toner images (in the case of a solid image, M/A is about 0.6 [mg/cm$^2$]). The Y, M, C, and Bk toner images are primarily transferred to the front surface of the intermediate transfer belt 21 in a superimposing manner in the above-described Y, M, C, and Bk primary transfer nips. Thus, a four-color superimposed toner image is formed on the front surface of the intermediate transfer belt 21.

In the related art, as described in Japanese Patent Application Laid-open No. 2003-186284, an image forming apparatus is known in which the target value of constant current control is changed depending on the image area ratio. In this image forming apparatus, in the primary transfer nip of the second color and the latter colors, the target current value is changed based on the image area ratio on the intermediate transfer belt as well as the image area ratio on the photosensitive element. Specifically, the target current value is changed depending on a value which is obtained by subtracting the area ratio of an area where toner on the photosensitive element and toner on the belt overlap each other from the sum of the image area ratio on the photosensitive element and the image area ratio on the belt. In Japanese Patent Application Laid-open No. 2003-186284, the reason why the image area ratio on the belt as well as the image area ratio on the photosensitive element is taken into consideration is that the primary transfer current is influenced by toner on the belt as well as toner on the photosensitive element.

Figure 18:
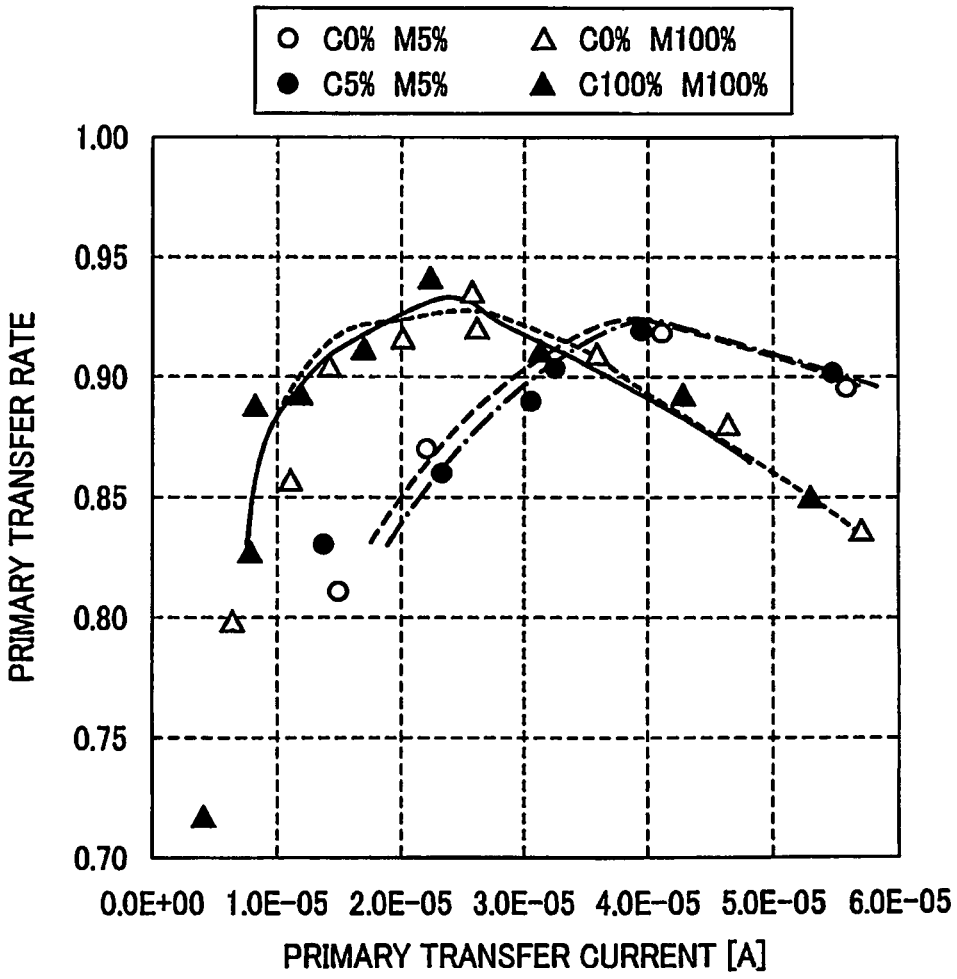
FIG. 18 is a graph showing a relationship between a primary transfer current, a primary transfer rate, and an interposition state of toner in a primary transfer nip in the printer.

However, as described above, the change in the primary transfer current depending on the image area ratio is influenced by the amount of electric charges of the non-image portion of the photosensitive element much greater than the image portion, not by toner interposed in the nip. Actually, the inventors have verified that through an experiment in which a printer tester having the same configuration as the printer of the first modification shown in FIG. 17 is used. FIG. 18 is a graph showing the relationship the primary transfer current measured at the time of test printing by the printer tester, the primary transfer rate, and the interposition state of toner in the primary transfer nip. As shown in the drawing, it can be seen that the primary transfer current or the primary transfer rate is scarcely influenced by the stuck toner amount on the toner, but is significantly influenced by the image area ratio of the photosensitive element.

In the image forming apparatus described in Japanese Patent Application Laid-open No. 2003-186284, when an area where a toner image on the photosensitive element and a toner image on the belt overlap each other is comparatively small compared to each image area, the primary transfer current is excessively lowered, causing defective transfer. When the overlap area is comparatively large, calculation is done to increase the transfer current for the overlap area, thus the primary transfer current excessively increases, causing reverse transfer. In order to determine overlapping, print position information of the respective colors is stored in a storage medium, such as a memory, and the overlap ratio for each color is calculated. Thus, it is necessary that a high-performance CPU or a large quantity of memory is provided.

Second Modification

Figure 19:
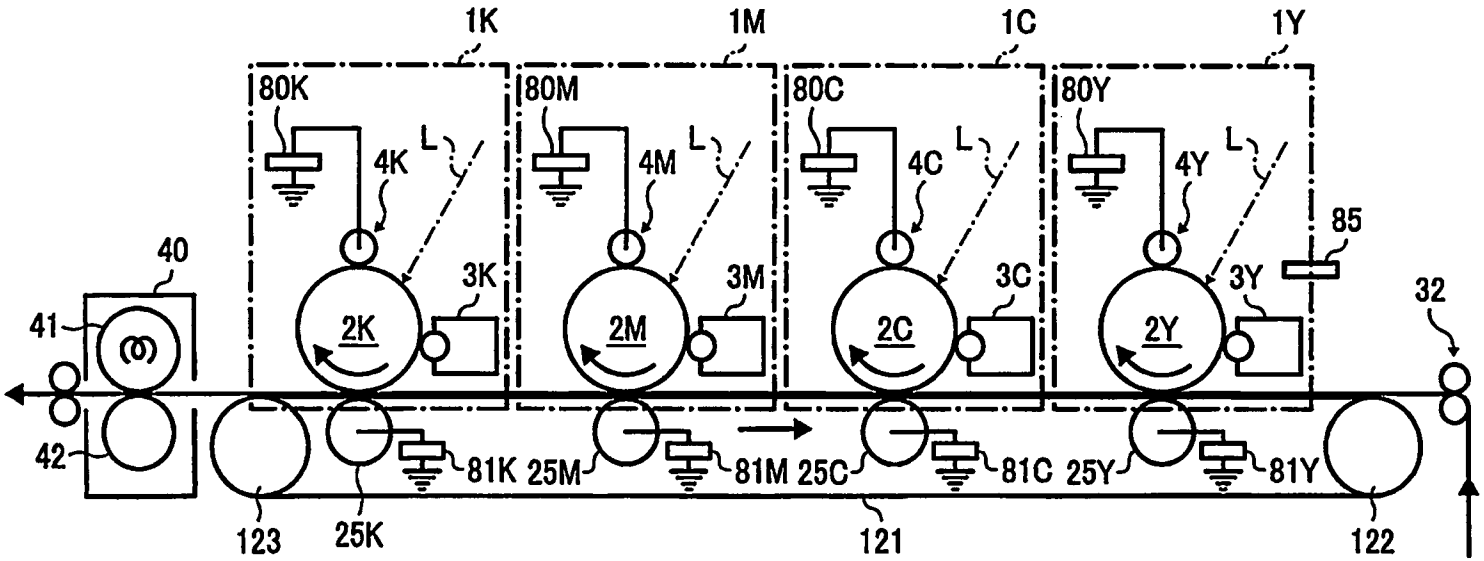
FIG. 19 is a schematic configuration diagram showing a printer according to a second modification.

FIG. 19 is a schematic configuration diagram showing a printer according to a second modification. The printer is different from the printer of to the embodiment in that, instead of the intermediate transfer belt, an endless sheet conveying belt 121 serving as a nip forming member 121 comes into contact with the photosensitive elements 2Y, 2M, 2C, and 2Bk of the respective colors. The sheet conveying belt 121 sequentially conveys the recording sheet held on the surface thereof to the Y, M, C, and Bk primary transfer nips in accordance with endless movement thereof. In this course, the Y, M, C, and Bk toner images on the photosensitive elements 2Y, 2M, 2C, and 2Bk are transferred to the surface of the recording sheet in a superimposing manner.

Third Modification

Figure 20:
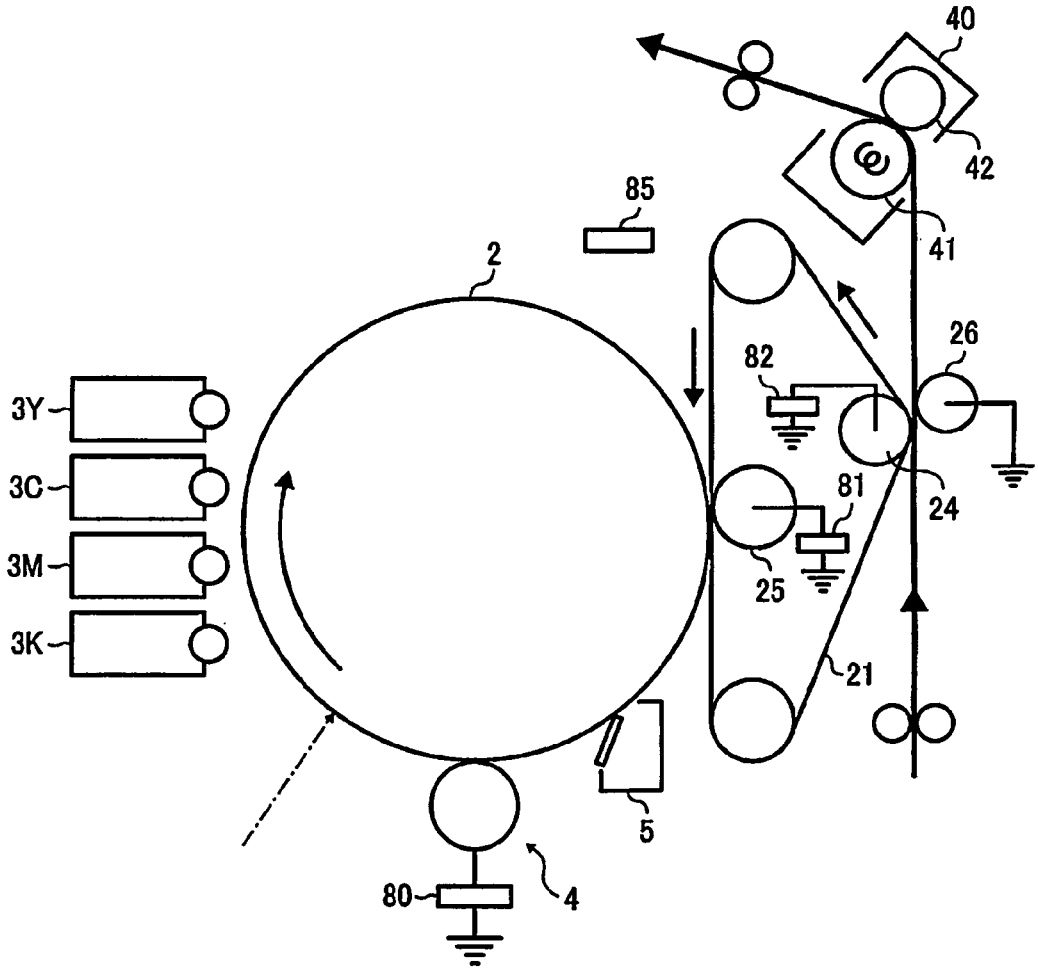
FIG. 20 is a schematic configuration diagram showing a printer according to a third modification.

FIG. 20 is a schematic configuration diagram showing a printer according to a third modification. The printer has Y, M, C, and Bk developing units 3Y, 3M, 3C, and 3Bk around a single photosensitive element 2.

In forming an image, first, the surface of the photosensitive element 2 is uniformly charged by a charging unit 4, and then laser light L modulated based on Y image data is irradiated onto the surface of the photosensitive element 2 to form a Y electrostatic latent image on the surface of the photosensitive element 2. The Y electrostatic latent image is developed by the developing unit 3Y to obtain a Y toner image, and the Y toner image is primarily transferred to the intermediate transfer belt 21. Thereafter, transfer residual toner on the surface of the photosensitive element 2 is removed by a drum cleaning unit 5, and the surface of the photosensitive element 2 is again uniformly charged by the charging unit. Next, laser light L modulated based on M image data is irradiated onto the surface of the photosensitive element 2 to form an M electrostatic latent image on the surface of the photosensitive element 2, and the M electrostatic latent image is developed by the developing unit 3M to obtain an M toner image. The M toner image is primarily transferred to be superimposed on the Y toner image on the intermediate transfer belt 21. Hereinafter, similarly, a C toner image and a Bk toner image are sequentially developed on the photosensitive element 2 and primarily transferred to be superimposed on the YM toner images on the belt. Thus, four-color toner images are formed on the intermediate transfer belt 21.

Thereafter, the four-color toner images on the intermediate transfer belt 21 are collectively secondarily transferred to the surface of the recording sheet in the secondary transfer nip to form a full color image on the recording sheet. The full color image is fixed to the recording sheet by the fixing unit 40, and then the recording sheet is discharged outside the apparatus.

In the configuration in which superimposing transfer is done by the revolution method, in the transfer step of the first color (first revolution), the same algorithm as the algorithm for Y in the embodiment is used. Meanwhile, in the transfer steps of the second color and later (second to fourth revolutions), the same algorithm as the algorithm for M in the embodiment is used.

As described above, the printer of the embodiment includes the photosensitive elements 2Y, 2M, 2C, and 2Bk serving as a latent image carrier, the developing units 3Y, 3M, 3C, and 3Bk serving as a developing unit which develop the electrostatic latent images of the photosensitive elements with toners to obtain the toner images, the intermediate transfer belt 21 serving as a nip forming member which comes into contact with the photosensitive elements to form the primary transfer nips, and the primary transfer power supplies 81Y, 81M, 81C, and 81Bk serving as a transfer current output unit which outputs the transfer current, which has the same current value as a predetermined target value, to the intermediate transfer belt 21 so as to transfer the toner images on the photosensitive elements to the intermediate transfer belt 21, and determines the target value based on the algorithm representing the relationship between the image area ratio of each of the toner images on the photosensitive elements and the target value and the image area ratio. Then, the first transfer step (the transfer step in the Y primary transfer nip or the transfer step in the above-described state B in the M, C, or Bk primary transfer nip) is performed in which the toner image on the photosensitive element is transferred to the intermediate transfer belt 21 to which no toner image is transferred, and the second transfer step (the transfer step for the above-described state C in the M, C, or Bk primary transfer nip) is performed in which the toner image on the photosensitive element is transferred to the intermediate transfer belt 21, to which the toner image has already been transferred, in a superimposing manner. Thus, the superimposed toner image is formed. Each of the primary transfer power supplies 81Y, 81M, 81C, and 81Bk is configured such that processing is performed using the algorithm, in which the target value having a smaller value is associated with the same image area ratio compared to the algorithm for the first transfer step, as the algorithm for the second transfer step (for the state C). With this configuration, as described above, inside the M, C, and Bk primary transfer nips, in the second transfer step (superimposing transfer step) in which the toner image on the intermediate transfer belt 21 is likely to come into contact with the non-image portion of the photosensitive element, the primary transfer current having a smaller value than in the first transfer step is output from the transfer current output unit as the primary transfer current corresponding to the image area ratio of the toner image. Thus, the potential difference between the non-image portion of the photosensitive element and the belt is reduced compared to a case where the same value as in the first transfer step is output, suppressing the occurrence of discharge between the non-image portion of the photosensitive element and the belt. Therefore, it is possible to suppress reverse transfer of toner from the belt to the non-image portion of the photosensitive element.

In the printer of the embodiment, in the second transfer step which is the transfer step for the state C in the M, C, or Bk primary transfer nip, when the average image area ratio of the "ten-line section" which is an area within a predetermined range from the exit of the primary transfer nip in the entire area of the photosensitive element is zero, each of the primary transfer power supplies 81M, 81C, and 81Bk is configured to perform processing such that the primary transfer current is set to be equal to or smaller than a predetermined limit value, instead of processing in which the primary transfer current having the same value as the target value is output. With this configuration, inside the M, C, and Bk primary transfer nips, when it is not necessary that the toner image is transferred from the photosensitive element to the intermediate transfer belt 21, the primary transfer current is set to be equal to or smaller than the lower limit value, avoiding reverse transfer of toner on the belt to the non-image portion of the photosensitive element.

In the printer of the embodiment, in the second transfer step, when the average image area ratio of the "belt area corresponding to ten lines" which is the area within a predetermined range from the exit of the primary transfer nip in the entire area of the intermediate transfer belt 21 in the circumferential direction is not zero, the algorithm for the above-described state C serving as a first algorithm is used as the algorithm for the second transfer step in each of the primary transfer power supplies 81M, 81C, and 81Bk. Meanwhile, when the average image area ratio is zero, each of the primary transfer power supplies 81M, 81C, and 81Bk is configured to perform processing using the algorithm for the above-described state B, in which the target value having a greater value is associated with the same image area ratio compared to the algorithm for the above-described state C, as the algorithm for the second transfer step. With this configuration, in a case that toner does not exist in the "belt area corresponding to ten lines" in the M, C, and Bk primary transfer nips, and reverse transfer of toner from the belt to the non-image portion of the photosensitive element does not occurs, the transfer electric field is intensified compared to a case where toner exists, increasing the primary transfer efficiency.

With these aspects, in each of the first transfer step and the second transfer step, the transfer current is changed depending on the image area ratio of the latent image carrier, suppressing occurrence of irregularity in image density depending on the image area ratio.

In the second transfer step (superimposing transfer step) in which the toner image on the nip forming member or the recording member is likely to come into contact with the non-image portion of the latent image carrier within the transfer nip, a transfer current having a value smaller than that in the first transfer step is output from the transfer current output unit as the transfer current corresponding to the image area ratio of the toner image. Thus, the potential difference between the non-image portion of the latent image carrier and the nip forming member is reduced compared to a case where the transfer current having the same value as in the first transfer step is output, suppressing occurrence of discharge therebetween. Therefore, it is possible to suppress reverse transfer of toner from the nip forming member or the recording member to the non-image portion of the latent image carrier.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier that carries a latent image;

a developing unit that develops the latent image on the latent image carrier with toner to obtain a toner image;

a nip forming member that comes into contact with the latent image carrier to form a transfer nip; and a transfer current output unit that outputs a transfer current having a same current value as a predetermined target value to the nip forming member to transfer the toner image on the latent image carrier to the nip forming member or a recording member held on a surface of the nip forming member, and determines the target value based on an algorithm representing a relationship between an image area ratio of the toner image on the latent image carrier and the target value and the image area ratio, wherein a first transfer step in which the toner image on the latent image carrier is transferred to the nip forming member or the recording member to which no toner image is transferred and a second transfer step in which the toner image on the latent image carrier is transferred to be superimposed on the toner image of the nip forming member or the recording member to which the toner image has already been transferred are performed to form a superimposed toner image, and the transfer current output unit is configured to perform processing as the algorithm for the second transfer step in which the target value having a smaller value is related to a same image area ratio compared to the algorithm for the first transfer step.

2. The image forming apparatus according to claim 1, wherein, in the second transfer step, when the image area ratio of an area within a predetermined range from an exit of the transfer nip in an entire area of the latent image carrier is zero, the transfer current output unit is configured to output the transfer current having a value which is equal to or smaller than a predetermined lower limit value, instead of the transfer current having the same current value as the target value.

3. The image forming apparatus according to claim 1, wherein, in the second transfer step, the transfer current output unit is configured to perform processing using a first algorithm as the algorithm for the second transfer step when the image area ratio of an area within a predetermined range from an exit of the transfer nip in an entire area of the nip forming member or the recording member is not zero and perform processing using a second algorithm, as the algorithm for the second transfer step, in which the target value having a greater value is related to a same image area ratio compared to the first algorithm when the image area ratio of the area within the predetermined range from the exit of the transfer nip in the entire area of the nip forming member or the recording member is zero.

4. The image forming apparatus according to claim 1, further comprising an algorithm update unit which stores, as a reverse transfer avoidance upper limit voltage Vrev, an output voltage value output from the transfer current output unit when a predetermined reverse transfer avoidance upper limit current Irev is output from the transfer current output unit in a state where a test toner image is moved into the transfer nip in the second transfer step to update the algorithm for the second transfer step based on a reference voltage for the second transfer step each time a predetermined timing is reached.

5. The image forming apparatus according to claim 4, wherein the algorithm update unit stores, as a critical transfer rate voltage Vdeg, an output voltage value output from the transfer current output unit when a predetermined critical transfer rate current Ideg is output from the transfer current output unit in a state where a test toner image on the latent image carrier is moved into the transfer nip in the first transfer step to update the algorithm for the first transfer step based on the critical transfer rate voltage Vdeg each time a predetermined timing is reached.

6. The image forming apparatus according to claim 1, further comprising an algorithm update unit which stores an output voltage value output from the transfer current output unit while a transfer current is output from the transfer current output unit in a state where a test toner image transferred to the nip forming member or the recording member in the first transfer step is moved into the transfer nip in the second transfer step, and detects a stuck toner amount per unit area for test toner on the nip forming member or the recording member after having passed through the transfer nip by using a stuck toner amount detection unit repeatedly while varying the transfer current, and calculates a reference voltage for the second transfer step that is a reference of the output voltage from the transfer current output unit for the second transfer step based on a relationship between a value of the transfer current and the stuck toner amount to update the algorithm for the second transfer step based on the calculation result each time a predetermined timing is reached.

7. The image forming apparatus according to claim 6, wherein the algorithm update unit stores an output voltage value output from the transfer current output unit while the transfer current is output from the transfer current output unit in a state where a test toner image on the latent image carrier is moved into the transfer nip in the first transfer step, and detects a stuck toner amount per unit area for the test toner on the nip forming member or the recording member after having passed through the transfer nip by using the stuck toner amount detection unit repeatedly while varying the transfer current, and calculates a reference voltage for the first transfer step that is a reference of the output voltage from the transfer current output unit for the first transfer step based on a relationship between the value of the transfer current and the stuck toner amount to update the algorithm for the first transfer step based on the calculation result each time a predetermined timing is reached.

8. The image forming apparatus according to claim 4, wherein the algorithm update unit updates the algorithm for the second transfer step based on an output voltage value output from the transfer current output unit when an area of the latent image carrier where an image area ratio is zero is moved into the transfer nip while an area of the nip forming member or the recording member where an image area ratio is zero is moved into the transfer nip in the second transfer step, a value of the transfer current, and the reference voltage for the second transfer step.

9. The image forming apparatus according to claim 6, wherein the algorithm update unit updates the algorithm for the second transfer step based on an output voltage value output from the transfer current output unit when an area of the latent image carrier where an image area ratio is zero is moved into the transfer nip while an area of the nip forming member or the recording member where an image area ratio is zero is moved into the transfer nip in the second transfer step, a value of the transfer current, and the reference voltage for the second transfer step.

10. The image forming apparatus according to claim 8, wherein the algorithm update unit updates the algorithm for the first transfer step based on an output voltage value output from the transfer current output unit when an area of the latent image carrier where an image area ratio is zero is moved into the transfer nip while an area of the nip forming member or the recording member where an image area ratio is zero is moved into the transfer nip in the first transfer step, the value of the transfer current, and a reference voltage for the first transfer step.

11. The image forming apparatus according to claim 9, wherein the algorithm update unit updates the algorithm for the first transfer step based on an output voltage value output from the transfer current output unit when an area of the latent image carrier where an image area ratio is zero is moved into the transfer nip while an area of the nip forming member or the recording member where an image area ratio is zero is moved into the transfer nip in the first transfer step, the value of the transfer current, and a reference voltage for the first transfer step.

12. The image forming apparatus according to claim 4, wherein the algorithm update unit sequentially stores an output voltage value output from the transfer current output unit for each image area ratio of an area within a predetermined range from an exit of the transfer nip in an entire area of the latent image carrier in a course of sequentially changing the image area ratio of the area within the predetermined range from the exit of the transfer nip in the entire area of the latent image carrier in accordance with surface movement of the latent image carrier while an area of the nip forming member or the recording member where an image area ratio is zero is moved into the transfer nip and a test toner image on the latent image carrier is moved into the transfer nip in the second transfer step to update the algorithm for the second transfer step based on a relationship between the image area ratio of the area within the predetermined range from the exit of the transfer nip in the entire area of the latent image carrier and the output voltage value and the reference voltage for the second transfer step.

13. The image forming apparatus according to claim 6, wherein the algorithm update unit sequentially stores an output voltage value output from the transfer current output unit for each image area ratio of an area within a predetermined range from an exit of the transfer nip in an entire area of the latent image carrier in a course of sequentially changing the image area ratio of the area within the predetermined range from the exit of the transfer nip in the entire area of the latent image carrier in accordance with surface movement of the latent image carrier while an area of the nip forming member or the recording member where an image area ratio is zero is moved into the transfer nip and a test toner image on the latent image carrier is moved into the transfer nip in the second transfer step to update the algorithm for the second transfer step based on a relationship between the image area ratio of the area within the predetermined range from the exit of the transfer nip in the entire area of the latent image carrier and the output voltage value and the reference voltage for the second transfer step.

14. The image forming apparatus according to claim 12, wherein the algorithm update unit sequentially stores an output voltage value output from the transfer current output unit for each image area ratio of an area within a predetermined range from an exit of the transfer nip in an entire area of the latent image carrier in a course of sequentially changing the image area ratio of the area within the predetermined range from the exit of the transfer nip in the entire area of the latent image carrier in accordance with surface movement of the latent image carrier while an area of the nip forming member or the recording member where an image area ratio is zero is moved into the transfer nip and a test toner image on the latent image carrier is moved into the transfer nip in the first transfer step to update the algorithm for the first transfer step based on a relationship between the image area ratio of the area within the predetermined range from the exit of the transfer nip in the entire area of the latent image carrier and the output voltage value and a reference voltage for the first transfer step.

15. The image forming apparatus according to claim 13, wherein the algorithm update unit sequentially stores an output voltage value output from the transfer current output unit for each image area ratio of an area within a predetermined range from an exit of the transfer nip in an entire area of the latent image carrier in a course of sequentially changing the image area ratio of the area within the predetermined range from the exit of the transfer nip in the entire area of the latent image carrier in accordance with surface movement of the latent image carrier while an area of the nip forming member or the recording member where an image area ratio is zero is moved into the transfer nip and a test toner image on the latent image carrier is moved into the transfer nip in the first transfer step to update the algorithm for the first transfer step based on a relationship between the image area ratio of the area within the predetermined range from the exit of the transfer nip in the entire area of the latent image carrier and the output voltage value and a reference voltage for the first transfer step.

16. The image forming apparatus according to claim 1, wherein the latent image carrier includes a plurality of separate latent image carriers, and the nip forming member comes into contact with the latent image carriers to form a plurality of transfer nips, and the first transfer step is performed in a transfer nip in which a transfer step is performed first among the transfer nips, and the second transfer step is performed in other transfer nips.

17. The image forming apparatus according claim 1, wherein the developing unit includes a plurality of developing units that respectively develop the latent image on the latent image carrier with toners of different colors, and a surface moved in an endless manner of the nip forming member comes into contact with the latent image carrier to form the transfer nip, and toner images of different colors are sequentially formed on the latent image carrier, and each toner image is transferred to the surface of the nip forming member in a superimposing manner in each revolution of the nip forming member, and the first transfer step is performed in a first revolution among the revolutions, and the second transfer step is performed in other revolutions.

18. The image forming apparatus according to claim 1, wherein the processing as the algorithm for the second transfer step in which the target value having a smaller value is related to a same image area ratio compared to the algorithm for the first transfer step does not depend on an area ratio of the superimposed toner image.

* * * * *